US011793373B2

(12) United States Patent
Brown

(10) Patent No.: US 11,793,373 B2
(45) Date of Patent: Oct. 24, 2023

(54) ROBOTIC CLEANER WITH AIR JET ASSEMBLY

(71) Applicant: SHARKNINJA OPERATING LLC, Needham, MA (US)

(72) Inventor: Andre D. Brown, Natick, MA (US)

(73) Assignee: SharkNinja Operating LLC, Needham, MA (US)

( * ) Notice: Subject to any disclaimer, the term of this patent is extended or adjusted under 35 U.S.C. 154(b) by 235 days.

(21) Appl. No.: 16/987,801

(22) Filed: Aug. 7, 2020

(65) Prior Publication Data

US 2021/0038032 A1 Feb. 11, 2021

Related U.S. Application Data

(60) Provisional application No. 62/884,303, filed on Aug. 8, 2019.

(51) Int. Cl.

| | |
|---|---|
| ***A47L 5/14*** | (2006.01) |
| ***A47L 9/08*** | (2006.01) |
| ***A47L 9/28*** | (2006.01) |

(52) U.S. Cl.

CPC ..... *A47L 5/14* (2013.01); *A47L 9/08* (2013.01); *A47L 9/2842* (2013.01); *A47L 2201/04* (2013.01)

(58) Field of Classification Search

CPC .... A47L 2201/04; A47L 2201/06; A47L 5/14; A47L 9/08; A47L 9/2842

See application file for complete search history.

(56) References Cited

U.S. PATENT DOCUMENTS

| | | | | |
|---|---|---|---|---|
| 2,064,344 | A | 12/1936 | Good | |
| 3,663,984 | A | 5/1972 | Anthony et al. | |
| 3,694,848 | A | 10/1972 | Alcala | |
| 4,070,586 | A | 1/1978 | Breslin | |
| 4,300,261 | A | 11/1981 | Woodward et al. | |
| 4,315,344 | A | 2/1982 | Woodward et al. | |
| 4,393,536 | A | 7/1983 | Tapp | |
| 4,884,315 | A | 12/1989 | Ehnert | |
| 5,613,269 | A | 3/1997 | Miwa | |
| 5,647,092 | A * | 7/1997 | Miwa | A47L 5/14 15/397 |

(Continued)

FOREIGN PATENT DOCUMENTS

| | | |
|---|---|---|
| CN | 1451347 | 10/2003 |
| CN | 101708116 B | 3/2012 |

(Continued)

OTHER PUBLICATIONS

US 8,266,760 B2, 09/2012, Morse et al. (withdrawn)

(Continued)

*Primary Examiner* — Marc Carlson
(74) *Attorney, Agent, or Firm* — Grossman Tucker Perreault & Pfleger, PLLC

(57) ABSTRACT

An example of a robotic cleaner, consistent with the present disclosure, may include a body, an agitator chamber defined in the body, a suction motor fluidly coupled to the agitator chamber and configured to cause air to flow into the agitator chamber, and at least one air jet assembly coupled to the body, the air jet assembly being configured to generate an air jet, the air jet being configured to urge debris toward the agitator chamber.

18 Claims, 16 Drawing Sheets

(56) References Cited

U.S. PATENT DOCUMENTS

| | | | | |
|---|---|---|---|---|
| 6,237,188 | B1 | 5/2001 | Takemoto et al. | |
| 6,324,722 | B1 | 12/2001 | Takemoto | |
| 6,725,500 | B2 | 4/2004 | Allen et al. | |
| 6,732,404 | B2 | 5/2004 | Fukuoka et al. | |
| 7,059,012 | B2 | 6/2006 | Song et al. | |
| 7,231,687 | B2 | 6/2007 | Rew et al. | |
| 7,458,130 | B1 | 12/2008 | Krymsky et al. | |
| 7,555,812 | B1 | 7/2009 | Pinney | |
| 7,610,651 | B2 | 11/2009 | Baek | |
| 7,620,476 | B2 | 11/2009 | Morse et al. | |
| 7,665,181 | B2 | 2/2010 | Gebhard et al. | |
| 7,761,954 | B2 | 7/2010 | Ziegler | |
| 7,788,765 | B2 | 9/2010 | Allen | |
| 8,468,645 | B2 | 6/2013 | Kim et al. | |
| 8,739,355 | B2 | 6/2014 | Morse et al. | |
| 8,782,848 | B2 | 7/2014 | Ziegler et al. | |
| 8,966,707 | B2 | 3/2015 | Morse et al. | |
| 9,801,510 | B2 | 10/2017 | Weiburg et al. | |
| 10,357,137 | B2 | 7/2019 | Holz | |
| 10,470,629 | B2 | 11/2019 | Ziegler et al. | |
| 10,602,893 | B2 | 3/2020 | Isenberg et al. | |
| 10,624,516 | B2 | 4/2020 | Cudzilo | |
| 10,694,908 | B2 | 6/2020 | Yan | |
| 10,863,878 | B2 | 12/2020 | Royce | |
| 11,076,730 | B2 | 8/2021 | Lee et al. | |
| 2002/0184730 | A1 | 12/2002 | Allen et al. | |
| 2003/0192144 | A1* | 10/2003 | Song | A47L 9/04 15/346 |
| 2006/0190132 | A1 | 8/2006 | Morse et al. | |
| 2006/0190133 | A1 | 8/2006 | Konandreas et al. | |
| 2006/0236491 | A1 | 10/2006 | Baek | |
| 2007/0039123 | A1 | 2/2007 | Bird | |
| 2007/0074371 | A1 | 4/2007 | Song et al. | |
| 2007/0089262 | A1 | 4/2007 | Drevitson et al. | |
| 2008/0000043 | A1 | 1/2008 | Frederickson | |
| 2008/0307602 | A1 | 12/2008 | Andriolo et al. | |
| 2009/0089964 | A1 | 4/2009 | Vanderlinden | |
| 2010/0088840 | A1* | 4/2010 | Kim | A47L 5/14 15/320 |
| 2012/0260454 | A1 | 10/2012 | Lester | |
| 2014/0230179 | A1* | 8/2014 | Matsubara | A47L 11/4097 15/319 |
| 2016/0051111 | A1* | 2/2016 | Lee | A47L 11/4027 15/364 |
| 2016/0095486 | A1 | 4/2016 | Al Salameh | |
| 2017/0215668 | A1 | 8/2017 | Lubbers et al. | |
| 2017/0260704 | A1 | 9/2017 | De Geyter | |
| 2018/0184866 | A1 | 7/2018 | Gebhard et al. | |
| 2019/0167052 | A1 | 6/2019 | Lee et al. | |
| 2019/0374081 | A1 | 12/2019 | Michael et al. | |
| 2020/0383547 | A1 | 12/2020 | Sutter et al. | |

FOREIGN PATENT DOCUMENTS

| | | |
|---|---|---|
| CN | 208002736 | 10/2018 |
| CN | 109480716 | 3/2019 |
| CN | 208864216 | 5/2019 |
| CN | 210697497 | 6/2020 |
| CN | 211484377 | 9/2020 |
| CN | 211534208 | 9/2020 |
| CN | 211534208 U | 9/2020 |
| CN | 211534245 | 9/2020 |
| CN | 212661761 | 3/2021 |
| CN | 110811434 | 12/2021 |
| DE | 102014105756 | 10/2015 |
| DE | 202017100064 | 5/2018 |
| DE | 112008001234 | 4/2021 |
| EP | 1850725 | 5/2010 |
| EP | 1716801 | 7/2013 |
| EP | 3194660 | 10/2018 |
| EP | 3189384 | 6/2019 |
| EP | 3100659 | 11/2020 |
| ES | 2712425 | 5/2019 |
| ES | 2746858 | 3/2020 |
| JP | H0889448 | 4/1996 |
| JP | 2007029488 | 2/2007 |
| WO | 2016038918 | 3/2016 |
| WO | 2019112249 | 6/2019 |

OTHER PUBLICATIONS

PCT Search Report and Written Opinion, dated Oct. 20, 2020, received in corresponding PCT Application No. PCT/US2020/45374, 9 pages.

PCT International Search Report and Written Opinion dated Dec. 21, 2017, received in PCT/US17/56484, 8 pgs.

Chinese Office Action with English translation dated Jul. 31, 2020, received in Chinese Patent Application No. 201780075887.2, 13 pgs.

Chinese Office Action with English translation dated Jan. 12, 2021, received in Chinese Patent Application No. 201780075887.2, 9 pages.

Chinese Decision of Rejection with English translation dated May 26, 2021, received in Chinese Patent Application No. 201780075887.2, 8 pages.

U.S. Office Action dated Jun. 18, 2021, received in U.S. Appl. No. 16/341,575, 7 pages.

Chinese First Notification to Make Rectification with English translation issued May 31, 2021, received in Chinese Utility Patent Application No. 20202163160.9, 2 pages.

U.S. Office Action dated Nov. 23, 2021, received in U.S. Appl. No. 16/341,575, 23 pages.

Chinese Office Action with English translation dated Jul. 11, 2022, received in Chinese Patent Application No. 202080056292.4, 23 pages.

U.S. Office Action dated Sep. 6, 2022, received in U.S. Appl. No. 16/341,575, 25 pages.

U.S. Office Action dated Dec. 30, 2022, received in U.S. Appl. No. 16/341,575, 33 pages.

Canadian Office Action dated Mar. 7, 2023, received in Canadian Patent Application No. 3,150,282, 4 pages.

Chinese Office Action with machine-generated English translation dated May 24, 2023, received in Chinese Patent Application No. 202080056292.4, 24 pages.

PCT Search Report and Written Opinion dated Jun. 30, 2023, received in PCT Application No. PCT/US2023/018301, 13 pages.

European Search Report dated Aug. 3, 2023, received in European Patent Application No. 20849948.3, 8 pages.

* cited by examiner

ROBOTIC CLEANER WITH AIR JET ASSEMBLY

CROSS-REFERENCE TO RELATED APPLICATIONS

The present application claims the benefit of U.S. Provisional Application Ser. No. 62/884,303 filed on Aug. 8, 2019, entitled Robotic Vacuum with Air Jet Assembly, which is fully incorporated herein by reference.

TECHNICAL FIELD

The present disclosure generally relates to surface cleaning apparatuses, and more particularly, to a robotic cleaner configured to generate an air jet.

BACKGROUND INFORMATION

The following is not an admission that anything discussed below is part of the prior art or part of the common general knowledge of a person skilled in the art.

A surface cleaning apparatus may be used to clean a variety of surfaces. Some surface cleaning apparatuses include a rotating agitator (e.g., brush roll). One example of a surface cleaning apparatus includes a vacuum cleaner which may include a rotating agitator and a suction motor. Non-limiting examples of vacuum cleaners include robotic vacuums, multi-surface robotic cleaners (e.g., a robotic cleaner capable of generating a vacuum and performing a mopping function), upright vacuum cleaners, canister vacuum cleaners, stick vacuum cleaners, and central vacuum systems. Another type of surface cleaning apparatus includes a powered broom which includes a rotating agitator (e.g., a brush roll) that collects debris, but does not include a vacuum source.

Within the field of robotic/autonomous cleaning devices, there are a range of form factors and features that have been developed to meet a range of cleaning needs. However, certain cleaning applications remain a challenge. For example, cleaning along vertical surfaces (e.g., along walls or windows) and within corners may be difficult for robotic cleaning devices. Effectively cleaning along such vertical surfaces while also being capable of reaching into corners raises numerous non-trivial design issues as well as navigational complexities to avoid robotic cleaners getting stuck/obstructed.

BRIEF DESCRIPTION OF THE DRAWINGS

These and other features advantages will be better understood by reading the following detailed description, taken together with the drawings wherein.

Figure 1:
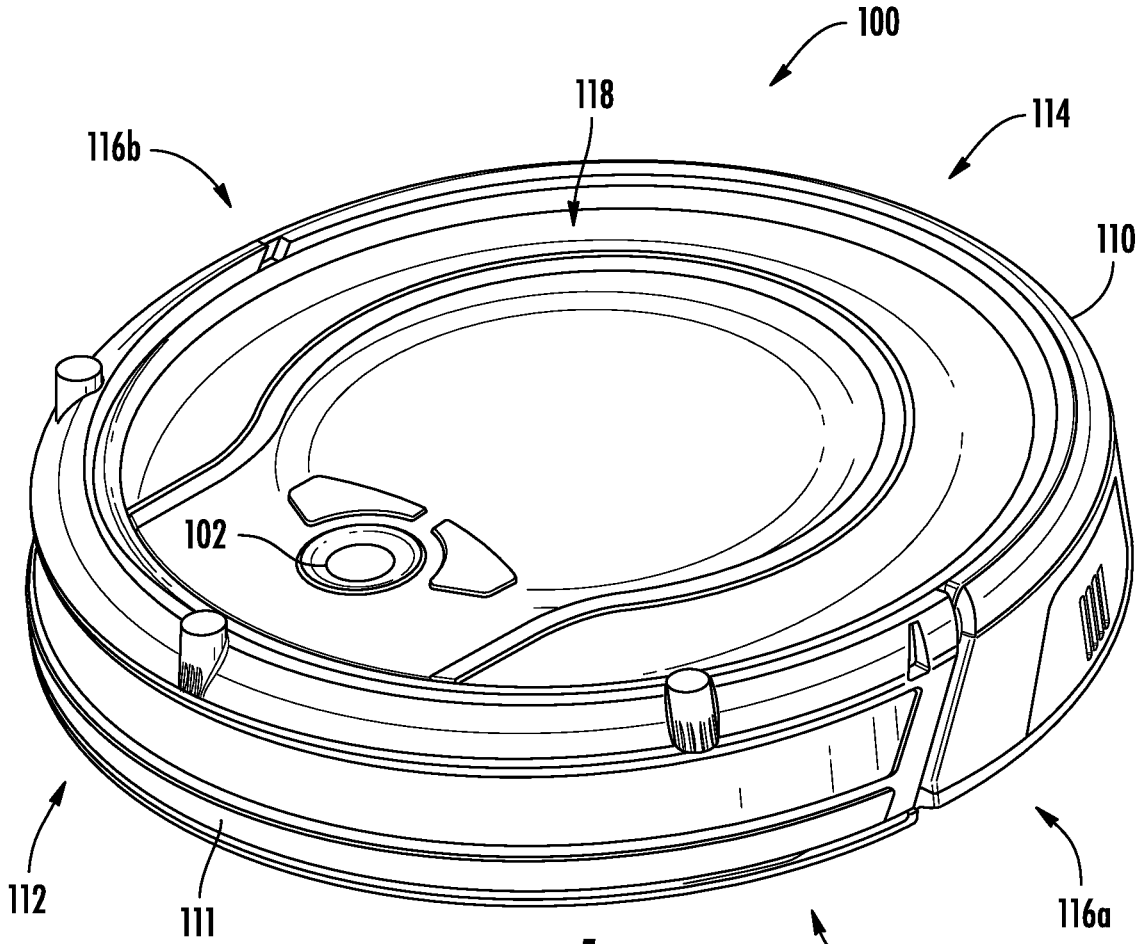
FIG. 1 is a top perspective view of a robotic cleaner, consistent with embodiments of the present disclosure.
Figure 2:
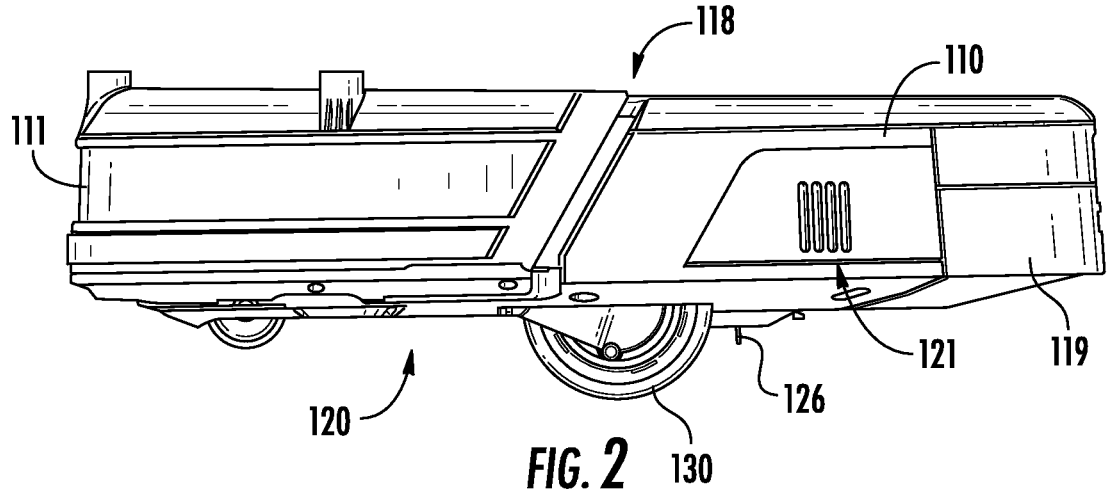
FIG. 2 is a side view of the robotic cleaner of FIG. 1, consistent with embodiments of the present disclosure.
Figure 3:
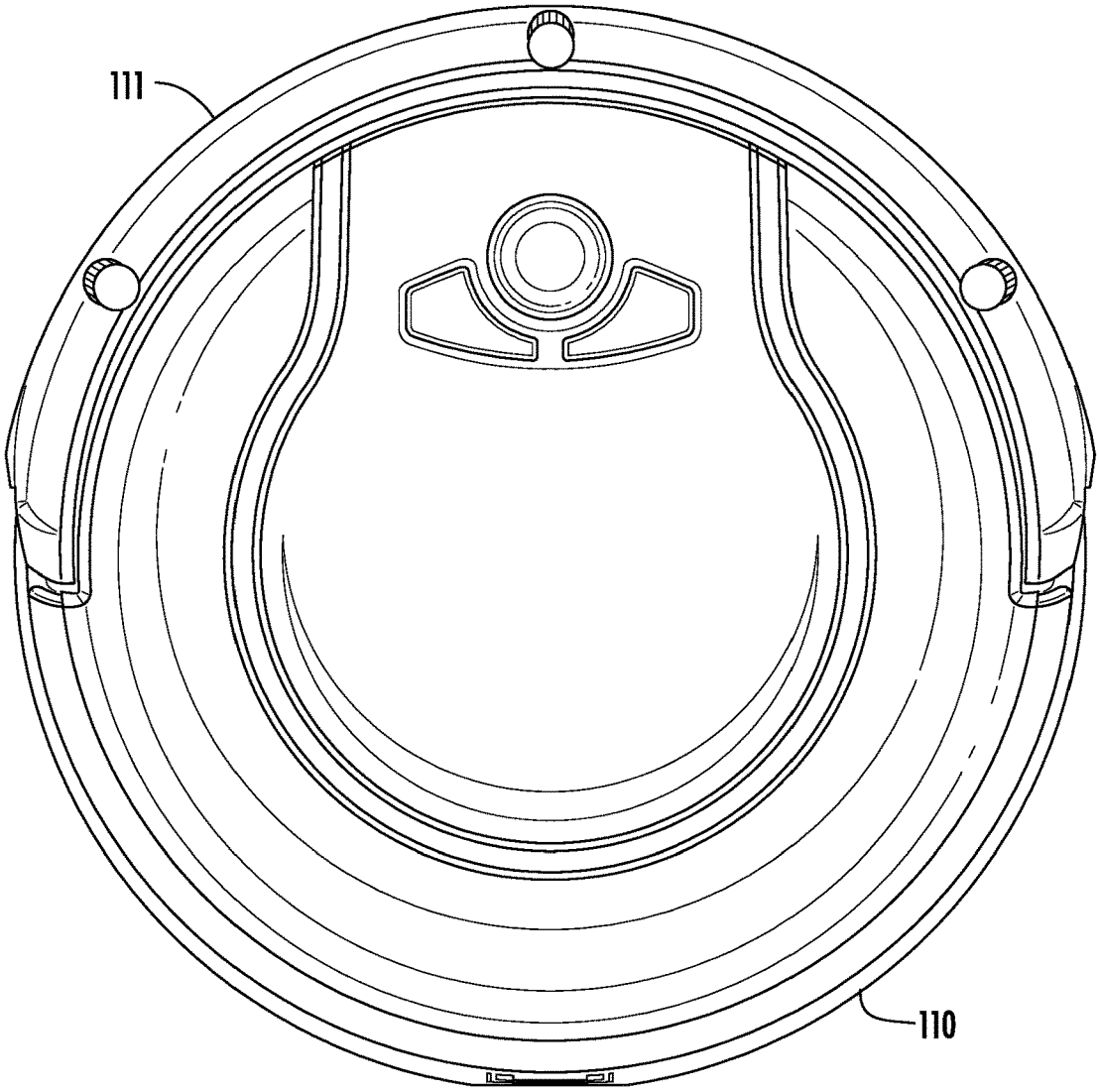
FIG. 3 is a top view of the robotic cleaner of FIG. 1, consistent with embodiments of the present disclosure.
Figure 4:
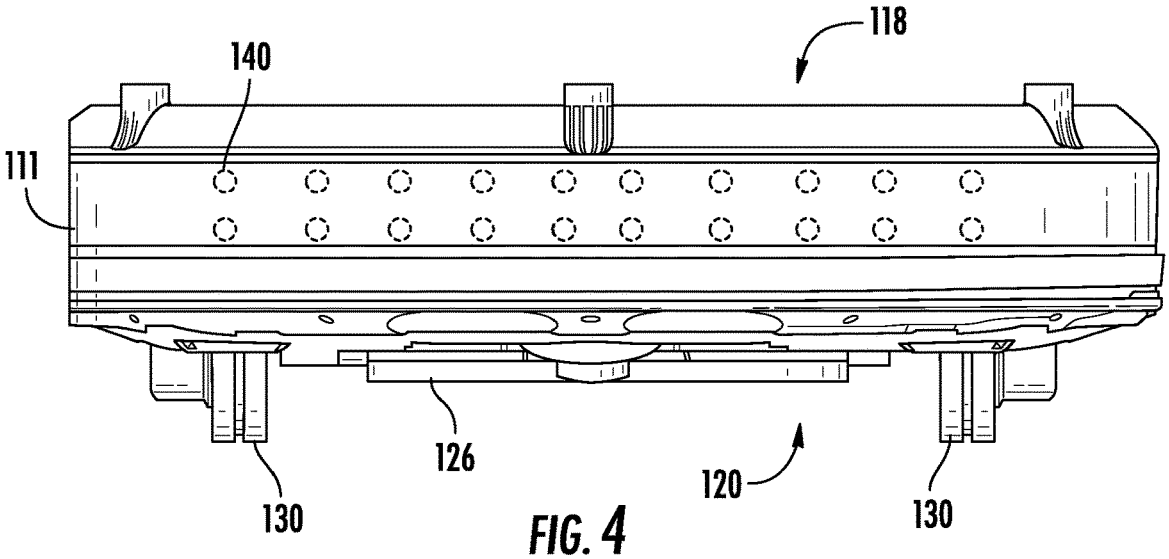
FIG. 4 is front view of the robotic cleaner of FIG. 1, consistent with embodiments of the present disclosure.

The drawings included herewith are for illustrating various examples of articles, methods, and apparatuses of the teaching of the present specification and are not intended to limit the scope of what is taught in any way.

DETAILED DESCRIPTION

The present disclosure is generally directed to a robotic cleaner. The robotic cleaner includes a body, an agitator chamber extending along an underside of the body, a suction motor configured to draw air into the agitator chamber, and an air jet assembly coupled to the body. The air jet assembly is configured to shape and direct air passing therethrough, generating an air jet. The air jet is configured to agitate debris adjacent to and/or adhered on a vertical surface (e.g., a wall or other obstacle extending from a floor), edge (e.g., a drop off, such as a staircase), and/or a corner defined at an intersection of two vertical surfaces. The air jet may be further configured to urge at least a portion of the agitated debris towards the agitator chamber such that at least a portion of the agitated debris may be drawn into the agitator chamber. As such, the air jet can generally be described as being configured to dislodge debris from one or more surfaces located outside of a movement path of the agitator chamber, increasing an effective cleaning width of the robotic cleaner. Such a configuration may allow the robotic cleaner to clean one or more surfaces that would be otherwise difficult for the robotic cleaner to clean as a result of, for example, a size and/or shape of the robotic cleaner.

The air jet assembly may include a nozzle having a nozzle inlet and a nozzle exit. The nozzle inlet may be fluidly coupled to one or more of an exhaust of the suction motor and/or a powered fan assembly such that the exhaust of the suction motor and/or the powered fan assembly causes a positive pressure to be generated at the nozzle exit. The nozzle inlet and the nozzle exit may be configured to have a different geometry and/or size. For example, the nozzle inlet may be larger than the nozzle exit such that a velocity of air flowing through the nozzle increases.

Additionally, or alternatively, the air jet assembly may include a vent. The vent may include one or more louvers configured shape and/or direct air passing through the vent into an air jet. The vent may be positioned such that the generated air jet extends beyond an outer perimeter of the robotic cleaner. Such a configuration may allow the generated air jet to be incident on a vertical surface proximate to the robotic cleaner.

Although the present disclosure specifically references floor-based robotic cleaning devices, this disclosure is not necessarily limited in this regard. Aspects and embodiments disclosed herein are equally applicable to hand held cleaning devices.

As used herein, the term "air jet assembly" may generally refer to one or more components, wherein one or more of the one or more components are configured to shape, direct, and/or introduce a velocity change to (e.g., increase a velocity of) air moving therethrough. In some instances, a portion of the air jet assembly extends/projects from a body of a robotic cleaner.

As used herein, the term "air jet" may generally refer to an airflow that has been modified (e.g., shaped, directed, and/or caused to undergo to a velocity change) by flowing through an air jet assembly. The term air jet is not intended to limit the air jet assembly to a particular shape or configuration.

As generally referred to herein, the term surface to be cleaned generally refers to a surface on which a robotic cleaning apparatus travels, such as a floor. As may be appreciated, one or more air jet assemblies may also allow the robotic cleaning apparatus to clean a surface that extends transverse to the surface to be cleaned such as a wall or other obstacle.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Referring to FIGS. 1-5, an example of a robotic cleaner 100 (e.g., a robotic vacuum cleaner), consistent with embodiments of the present disclosure, is shown and described. Although a particular embodiment of a robotic cleaner is shown and described herein, the concepts of the present disclosure may apply to other types robotic cleaners, including, for example, robotic multi-surface cleaners and robotic mops.

The robotic cleaner 100 includes a housing (or body) 110 with a front side 112, and a back side 114, left and right sides 116*a*, 116*b*, an upper side (or top surface) 118, and a lower side or underside (or bottom surface) 120. In some instances, a bumper 111 may be movably coupled to the housing 110 such that the bumper 111 extends around at least a portion of the housing 110 (e.g., a front portion and/or front half of the housing 110). The top surface 118 of the housing 110 may include controls 102 (e.g., buttons) to initiate certain operations, such as autonomous cleaning, spot cleaning, and docking and indicators (e.g., LEDs) to indicate operations, battery charge levels, errors, and other information. The robotic cleaner 100 may further include one or more air jet assemblies (not shown), which are discussed in further detail below. The air jet assemblies may be fluidly coupled to one or more air ducts or outlets of the robotic cleaner 100 (e.g., clean air outlets, air outlet ports, fan outlets, clean air exhaust ducts, or exhaust ducts).

Figure 5:
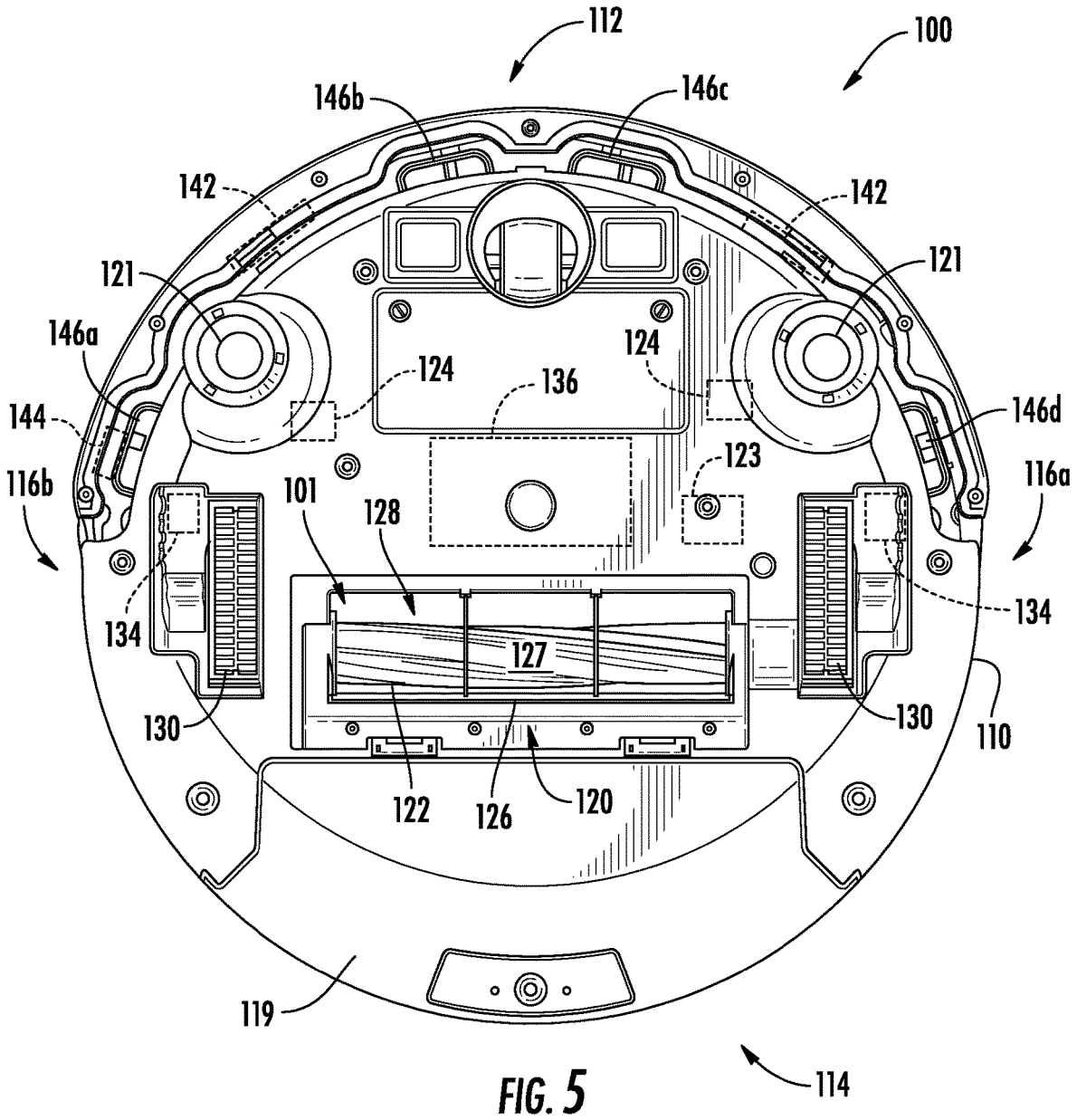
FIG. 5 is a bottom view of the robotic cleaner of FIG. 1, consistent with embodiments of the present disclosure.

In the illustrated example embodiment, and as shown in FIG. 5, the housing 110 further includes a suction conduit 128. The suction conduit 128 includes an agitator chamber 101 having an opening 127 on the underside 120 of the housing 110. The agitator chamber 101 includes (e.g., defines) a dirty air inlet (not shown) that is fluidly coupled to a suction motor (not shown) of the robotic cleaner 100. The opening 127 can be described as defining an open end of the suction conduit 128 through which air is drawn by the suction motor. At least a portion of the agitator chamber 101 may be defined by the housing 110. For example, the agitator chamber 101 may be defined by a cavity of the housing 110, wherein the cavity includes the opening 127.

A debris collector 119, such as a removable dust bin, is located in or integrated with the housing 110. The debris collector 119 can be disposed within the suction conduit 128 at a position between the agitator chamber 101 and the suction motor. As such, at least a portion of debris entrained within air flowing into the debris collector 119 may be collected within the debris collector 119.

The robotic cleaner 100 may also include one or more clean air outlets 121. The one or more clean air outlets 121 may be fluidly coupled to the suction conduit 128. For example, the suction motor may be disposed at location along the suction conduit 128 that is between the one or more clean air outlets 121 and the debris collector 119. Additionally, or alternatively, one or more powered fan assemblies may be fluidly coupled to the one or more clean air outlets 121. For example, the suction motor may be fluidly coupled to a first inlet of the clean air outlets 121 and the fan assembly may be fluidly coupled to a second inlet of the clean air outlets 121. As shown, the one or more clean air outlets 121 can be disposed on the underside 120 of the housing 110.

The suction conduit 128 may include any suitable combination of rigid conduits, flexible conduits, chambers, and/or other features that may cooperate to direct a flow of air through the robotic cleaner 100. Optionally, one or more filters or filtration members, for example a high efficiency particulate air (HEPA) filter, can be configured such that air traveling through the suction conduit 128 passes through the one or more filters prior to the one or more clean air outlets 121. The one or more clean air outlets 121 may be configured to fluidly connect to one or more air jet assemblies.

In one embodiment, the robotic cleaner 100 may also include one or more cavities on the underside 120 of the housing 110. The one or more cavities include one or more fan outlets. The one or more fan outlets are fluidly coupled to a secondary air inlet (not shown) such that an air path extends from the secondary air inlet to the one or more fan outlets. The air path may include any suitable combination of rigid conduits, flexible conduits, chambers, and/or other features that may cooperate to direct a flow of air through the robotic cleaner. The one or more fan outlets may be may be configured to fluidly connect to one or more air jet assemblies.

The one or more air jet assemblies may include one or more nozzles configured to generate air jets when air passes therethrough, as described in further detail herein. The nozzle may be configured to be articulable such that an angle formed between a surface to be cleaned and an air jet generated by the nozzle can be adjusted. In some instances, the nozzles may be self-articulating (e.g., in response to actuation of one or more articulation motors controlled by, for example, a controller 136).

The robotic cleaner 100 may include a rotating agitator 122 (e.g., a main brush roll). The rotating agitator 122 rotates about a substantially horizontal axis to urge debris towards the debris collector 119. The rotating agitator 122 is at least partially disposed within the agitator chamber 101 of the suction conduit 128. The rotating agitator 122 may be coupled to a motor 123, such as an AC or DC motor, to impart rotation to the rotating agitator 122 by way of, for example, one or more drive belts, gears, and/or any other driving mechanism.

The rotating agitator 122 may have bristles, fabric, or other cleaning elements, or any combination thereof around the outside of the agitator 122. The rotating agitator 122 may include, for example, strips of bristles in combination with strips of a rubber or elastomer material. The rotating agitator 122 may also be removable to allow the rotating agitator 122 to be cleaned more easily and allow the user to change the size of the rotating agitator 122, change type of bristles on the rotating agitator 122, and/or remove the rotating agitator 122 entirely depending on the intended application. The robotic cleaner 100 may further include a bristle strip 126 on an underside of the housing 110 and adjacent a portion of the suction conduit 128 (e.g., along a periphery of the opening 127). The bristle strip 126 may include bristles having a length sufficient to at least partially contact the surface to be cleaned. The bristle strip 126 may also be angled, for example, towards the agitator chamber 101 of the suction conduit 128.

The robotic cleaner 100 may also include several different types of sensors. For example, the robotic cleaner 100 may include one or more forward obstacles sensors 140 (FIG. 4) configured to detect obstacles in a travel path of the robotic cleaner 100. The one or more forward obstacle sensors 140 may be integrated with and/or separate from the bumper 111. For example, the one or more forward obstacles sensors 140 may be configured to cooperate with the bumper 111 such that signals emitted from the forward obstacle sensors 140 can pass through at least a portion of the bumper 111. The one or more forward obstacle sensors 140 may include one or more of infrared sensors, ultrasonic sensors, time-of-flight sensors, a camera (e.g., a stereo or monocular camera), and/or any other sensor.

One or more bump sensors 142 (e.g., optical switches behind the bumper) detect contact of the bumper 111 with obstacles during operation. One or more wall sensors 144 (e.g., an infrared sensor directed laterally to a side of the housing) detect a side wall when traveling along a wall (e.g., wall following). Cliff sensors 146*a-d* (e.g., infrared sensors, time-of-flight sensors) can be located adjacent a periphery of the underside 120 of the housing 110 and are configured to detect the absence of a surface on which the robotic cleaner 100 is traveling (e.g., staircases or other drop offs).

The controller 136 is communicatively coupled to the sensors (e.g., the bump sensors, wheel drop sensors, rotation sensors, forward obstacle sensors, side wall sensors, cliff sensors) and to the driving mechanisms (e.g., the motor 123 configured to cause the rotating agitator 122 to rotate, drive motor(s) 124 configured to control one or more features of an air jet assembly, and/or the wheel drive motors 134) for controlling movement and/or other functions of the robotic cleaner 100. Thus, the controller 136 can be configured to operate the drive wheels 130, air jet assemblies, and/or agitator 122 in response to sensed conditions, for example, according to known techniques in the field of robotic cleaners. The controller 136 may operate the robotic cleaner 100 to perform various operations such as autonomous cleaning (including randomly moving and turning, wall following and obstacle following), spot cleaning, and docking. The controller 136 may also operate the robotic cleaner 100 to avoid obstacles and cliffs and to escape from various situations where the robot may become stuck. The controller 136 may include any combination of hardware (e.g., one or more microprocessors) and software known for use in mobile robots.

Figure 6:
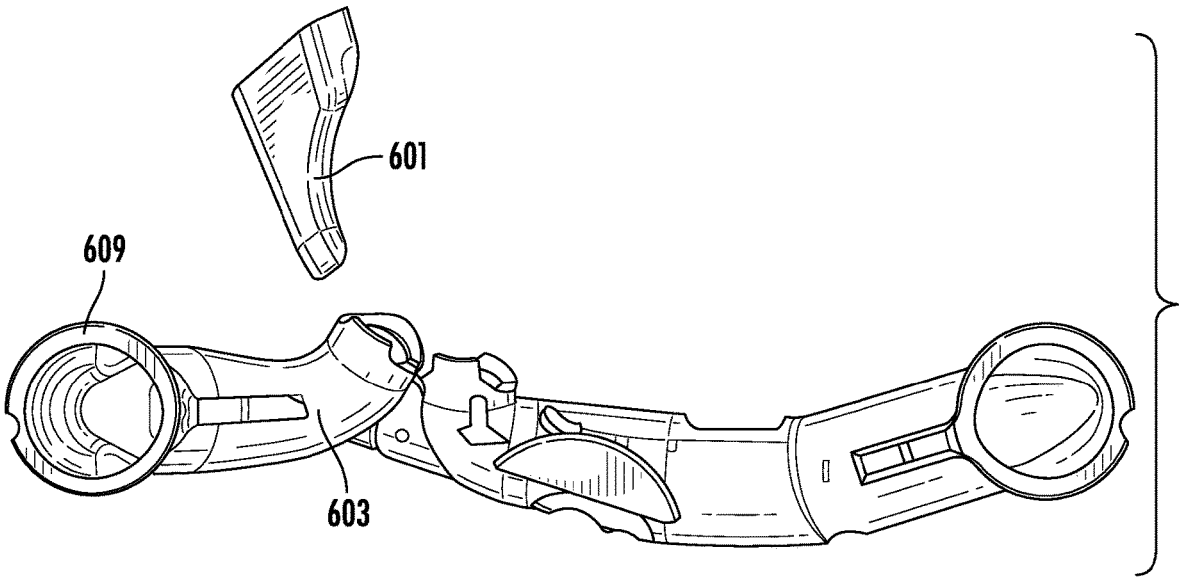
FIG. 6 is a perspective view of an example ducting system capable of being used with the surface cleaning apparatus of FIG. 1, consistent with embodiments of the present disclosure.
Figure 7:
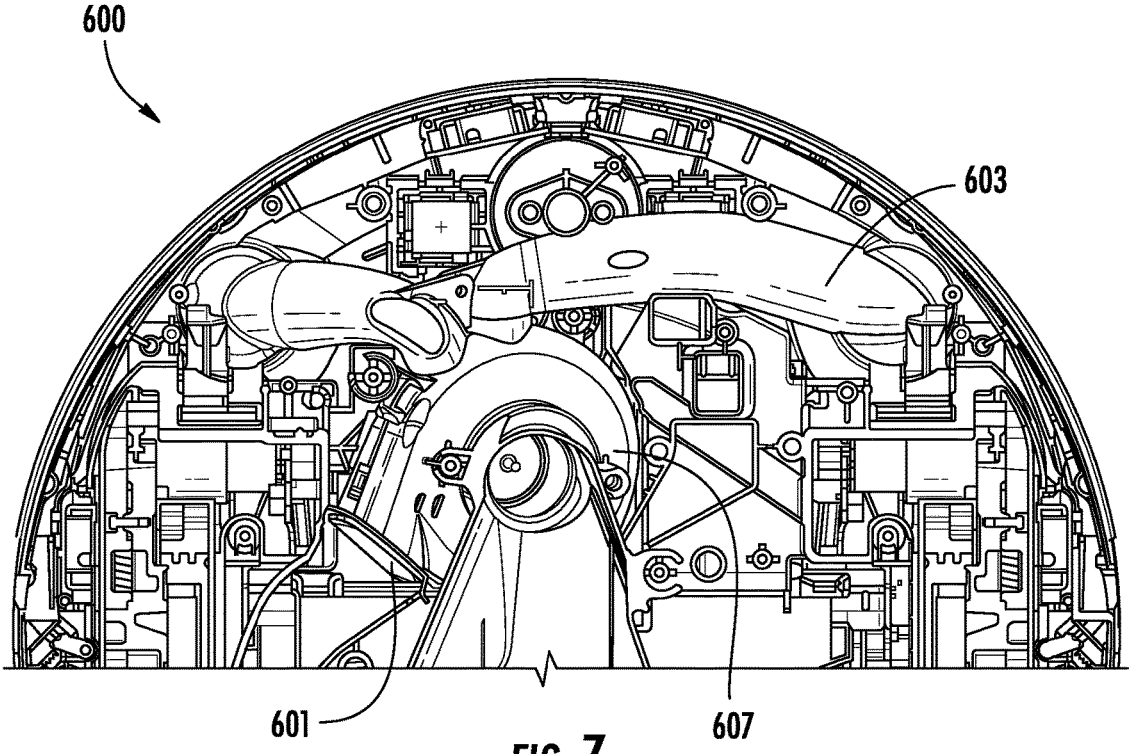
FIG. 7 is a cross-sectional view of a portion of a robotic cleaner that includes the ducting system of FIG. 6, consistent with embodiments of the present disclosure.
Figure 8:
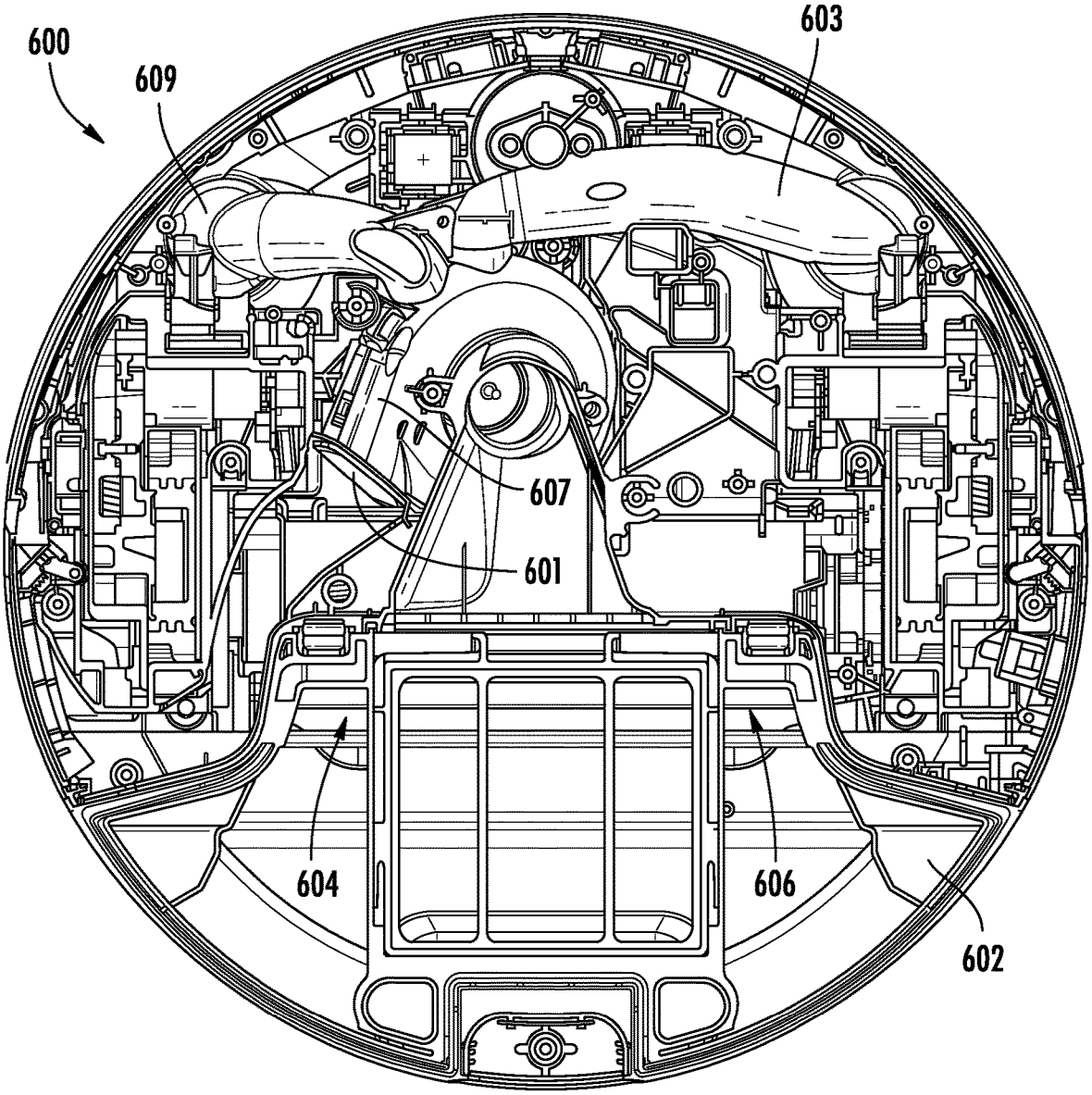
FIG. 8 is a cross-sectional view of a robotic cleaner that includes the ducting system of FIG. 6, consistent with embodiments of the present disclosure.

As shown in FIGS. 6-8, a robotic cleaner 600 may include a suction motor 607, a debris collector 602, an agitator chamber 604 having a dirty air inlet 606, and internal ducting 603. The suction motor 607 is fluidly coupled to the dirty air inlet 606 of the agitator chamber 604, the debris collector 602, and the internal ducting 603. The suction motor 607 is configured to generate suction within the agitator chamber 604, causing air to flow through the dirty air inlet 606 and the debris collector 602 and into a suction side of the suction motor 607. The air flowing into the suction motor 607 is exhausted from an exhaust side of the suction motor 607 and into the internal ducting 603. The internal ducting 603 is fluidly coupled to an air outlet 609 such that air flowing through the internal ducting 603 passes through the air outlet 609. The air outlet 609 may include and/or be fluidly coupled to an air jet assembly. As such, the positive air pressure generated on the exhaust side of the suction motor 607 may be directed through the air outlet 609 and the air jet assembly. The agitator chamber 604, the debris collector 602, the suction motor 607, the internal ducting 603, and the air outlet 609 may generally be described as forming at least part of a suction conduit within the robotic cleaner 600.

In some instances (e.g., in the absence of internal ducting 603), air may be exhausted through an exhaust port (not shown) on the robotic cleaner 600. In this instance, an exhaust outlet plug 601 may be used to redirect the flow of air from the exhaust port and through the internal ducting 603 and to the air outlet 609.

Figure 9A:
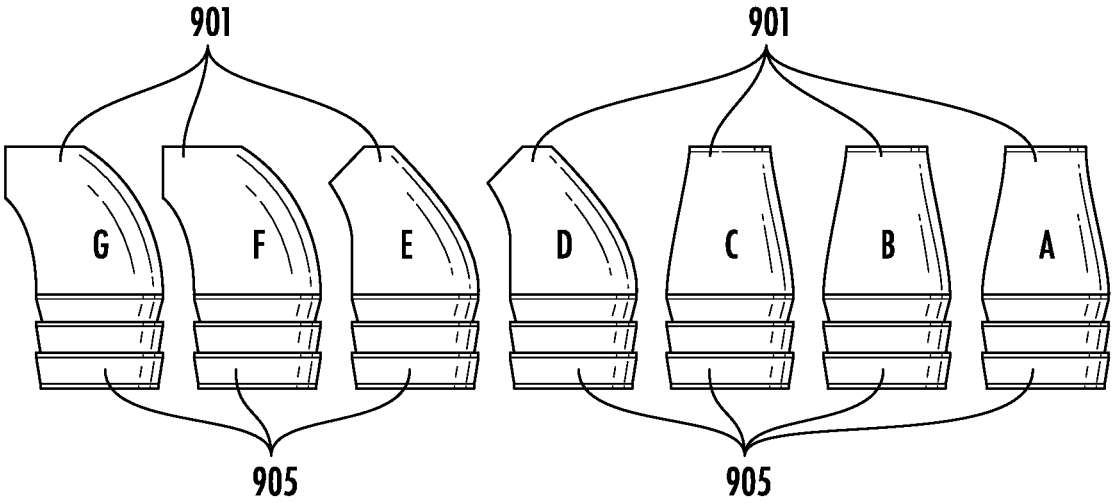
FIG. 9A is a side view of a plurality of example of nozzles that may be used with air jet assemblies, consistent with embodiments of the present disclosure.

FIGS. 9A-11B illustrate example embodiments of nozzles that may be used as components of air jet assemblies. FIGS. 9A and 9B are schematic views of nozzles A-G that may be used as components of air jet assemblies consistent with embodiments of the present disclosure. FIG. 9A is a side view of the nozzles A-G that may be used as components of air jet assemblies consistent with embodiments of the present disclosure. FIG. 9B is a perspective view of the nozzles A-G that may be used as components of air jet assemblies consistent with embodiments of the present disclosure. Nozzles, when used as components of air jet assemblies, may be configured to regulate air flow velocity, direction, and/or shape.

The air jet assembly is configured to be fluidly coupled to a suction conduit of a robotic cleaner such that air flowing through the suction conduit passes through the air jet assembly. A nozzle of the air jet assembly is configured to regulate a shape, direction, and/or velocity of air passing therethrough. For example, the nozzle may be configured to cause a velocity of air flowing therethrough to increase. As such, a nozzle can generally be described as being capable of being configured produce an air jet having desired properties.

The nozzle includes a nozzle inlet 905 and a nozzle exit 901. Air flows first through the nozzle inlet 905 and then through the nozzle exit 901 to be exhausted into a surrounding environment. The nozzle inlet 905 may have a different size and/or shape than the nozzle exit 901. For example, a size of the nozzle inlet 905 may measure greater than a size of the nozzle exit 901, increasing a velocity of air flowing through the nozzle. In some instances (e.g., as shown in nozzle D, E, F, and G), the nozzle inlet 905 and the nozzle exit 901 may extend transverse to each other. Such a configuration may allow air passing through the nozzle to be directed towards a desired location.

Figure 9B:
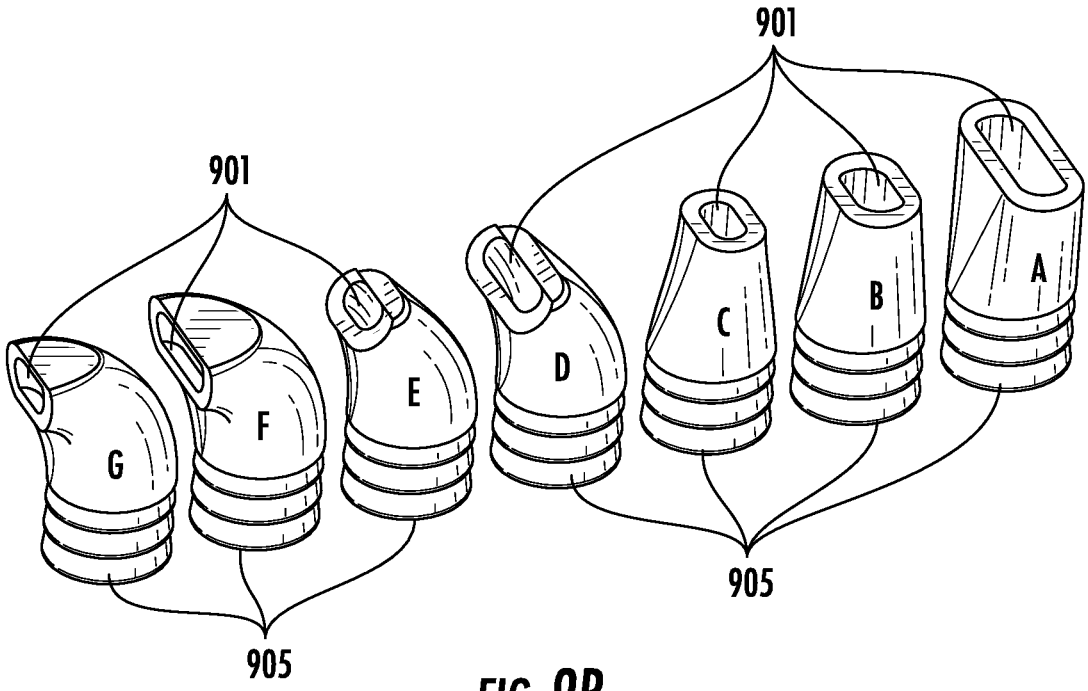
FIG. 9B is a perspective view of the nozzles of FIG. 9A, consistent with embodiments of the present disclosure.

As seen in FIGS. 9A and 9B, different nozzles having various shapes may be used as components of air jet assemblies. The nozzle selected as a component in an air jet assembly may be selected based on desired air jet properties. The size of the nozzle exit 901 partially controls the velocity of the air defining the generated air jet as the air leaves the nozzle exit 901. The angle of the nozzle exit 901 relative to the nozzle inlet 905 partially controls the velocity of the air defining the generated air jet as the air leaves the nozzle exit 901 by controlling the direction of air movement.

The nozzle exit 901 can be configured to throttle the air flow. As such, an air jet generated using a nozzle having a small nozzle exit 901 will have an air flow that moves at a higher velocity than an air jet generated using a nozzle having a comparatively larger nozzle exit 901. As seen in FIGS. 9A and 9B, nozzles C, E, and G generate an air jet that is comparatively narrower than nozzles A, B, D, and F. Therefore, the air defining the air jet generated by nozzles C, E, and G has a higher velocity than the air defining the air jet generated by nozzles A, B, D, and F. A higher air velocity may provide better agitation of debris stuck on or near walls or that is in a corner.

The configuration, orientation, and/or position of the air jet assembly may be such that the nozzle exit 901 generates an air jet in a desired direction. For example, air flows into the nozzle inlet 905 according to a first direction (e.g., a direction substantially perpendicular to a surface to be cleaned) and flows from the nozzle exit 901 according to a second direction (e.g., along a direction that is non-perpendicular to the surface to be cleaned), wherein the first direction is different from (or the same as) the second direction. As such, the nozzle can generally be described as being configured to adjust a flow direction of air passing therethrough.

Referring to FIGS. 9A and 9B, when the air jet assembly is positioned on an underside of the robotic cleaner, embodiments of the air jet assembly that use nozzles A-C generate an air jet that is directed towards the surface to be cleaned at an angle that is substantially perpendicular to the surface to be cleaned. Embodiments that use nozzles D and E generate air jets with a flow of air that moves inboard (or outboard) at a substantially (e.g., within 1°, 2°, 3°, 4°, or 5° of) 45° angle. Embodiments that use nozzles F and G generate air jets with a flow of air that moves inboard (or outboard) at a substantially (e.g., within 1°, 2°, 3°, 4°, or 5° of) 90° angle. In some instances, the nozzles may be further oriented such that the air is directed at an angle relative to the aft of the robotic cleaner. Such an orientation would alter the path of the air jet in relation to the surface to be cleaned such that the air jet extends towards an agitator chamber of the robotic cleaner.

Figure 10A:
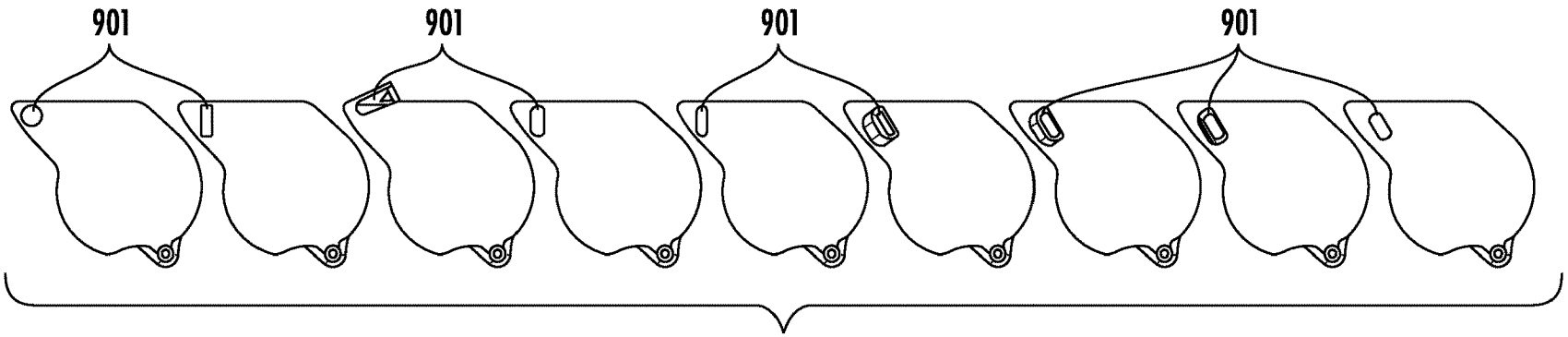
FIG. 10A is a top view of a plurality of example nozzles that may be used with air jet assemblies, consistent with embodiments of the present disclosure.
Figure 10B:
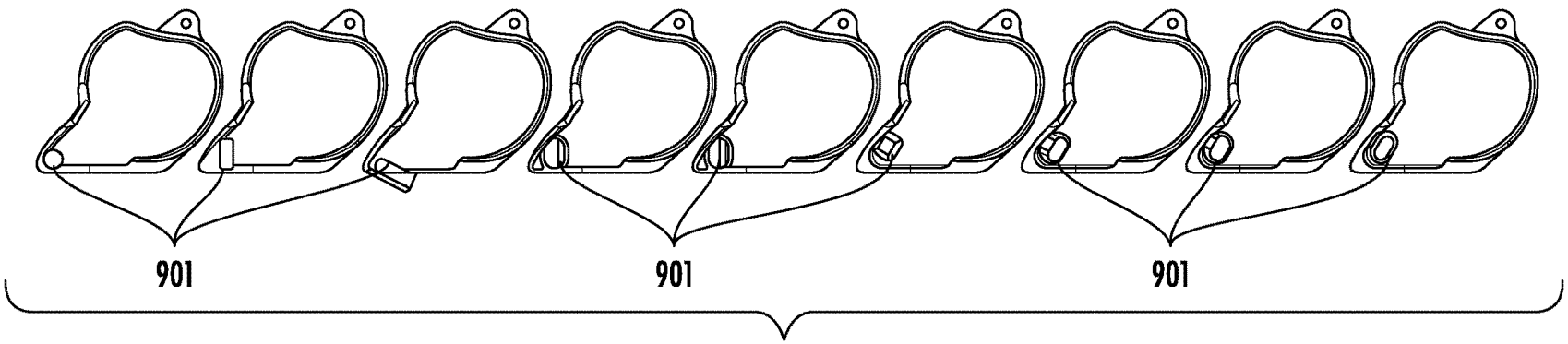
FIG. 10B is a bottom view of the nozzles of FIG. 10A, consistent with embodiments of the present disclosure.
Figure 11A:
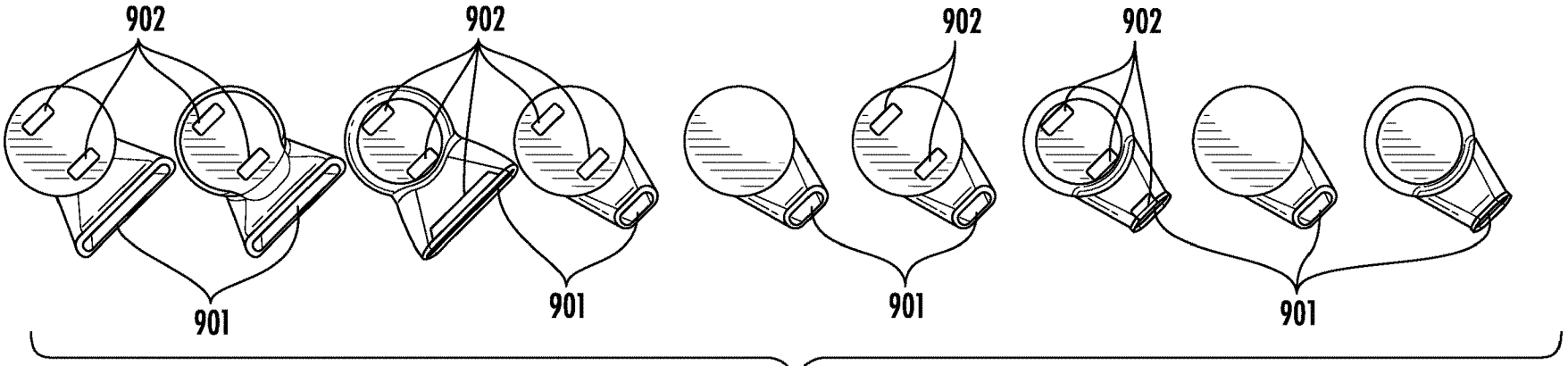
FIG. 11A is a bottom view of a plurality of example nozzles that may be used with air jet assemblies, consistent with embodiments of the present disclosure.
Figure 11B:
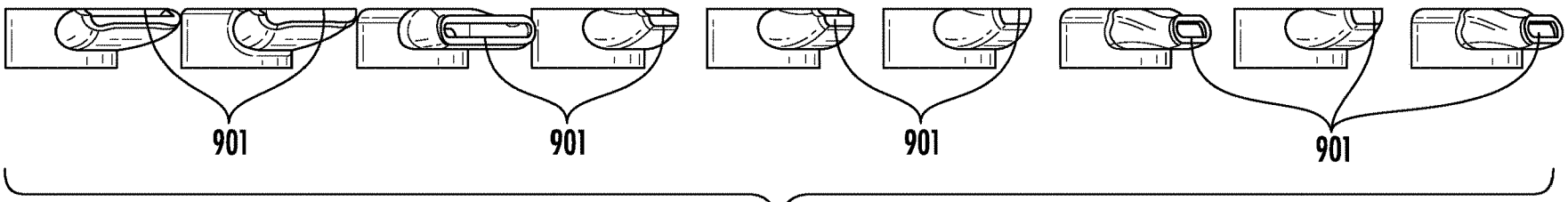
FIG. 11B is a perspective side view of the nozzles of FIG. 11A, consistent with embodiments of the present disclosure.

Additional nozzle embodiments are illustrated in FIGS. 10A-11B. FIG. 10A is a top view of nozzles that may be used as components of air jet assemblies consistent with embodiments of the present disclosure. FIG. 10B is a bottom view of the nozzles of FIG. 10A that may be used as components of air jet assemblies consistent with embodiments of the present disclosure. FIG. 11A is a bottom view of nozzles that may be used as components of air jet assemblies consistent with embodiments of the present disclosure. FIG. 11B is a side view of the nozzles of FIG. 11A that may be used as components of air jet assemblies consistent with embodiments of the present disclosure.

The placement and angling of the nozzles may be adjusted relative to the housing of the robotic cleaner and the agitator chamber. For example, nozzles can be configured to generate air jets that are directed directly at a cleaning surface (e.g., air jets that extend perpendicular to the cleaning surface) and/or air jets directed at a non-perpendicular angle relative to the cleaning surface. The nozzles can be designed to provide different air jet profiles. For example, the size and shape of the nozzle exits 901 produces air jets with a variety of properties. In some instances, the air jet assemblies can be configured to generate vortical air jets as air exits the nozzle. Some nozzles, as seen in FIG. 11A, have secondary nozzle exits 902 that produce additional air jets.

Figure 12:
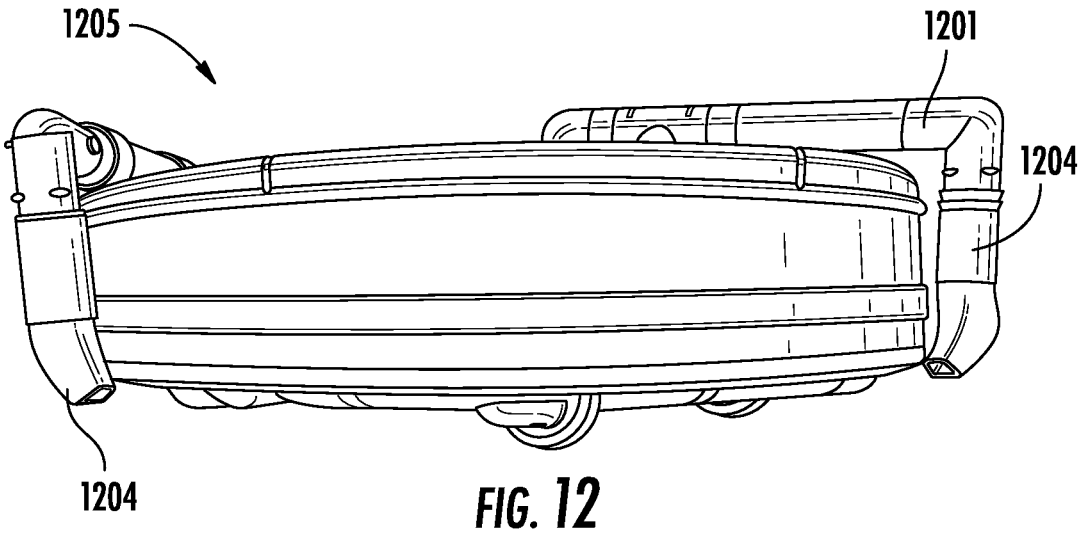
FIG. 12 is a front view of a robotic cleaner, consistent with embodiments of the present disclosure.
Figure 13:
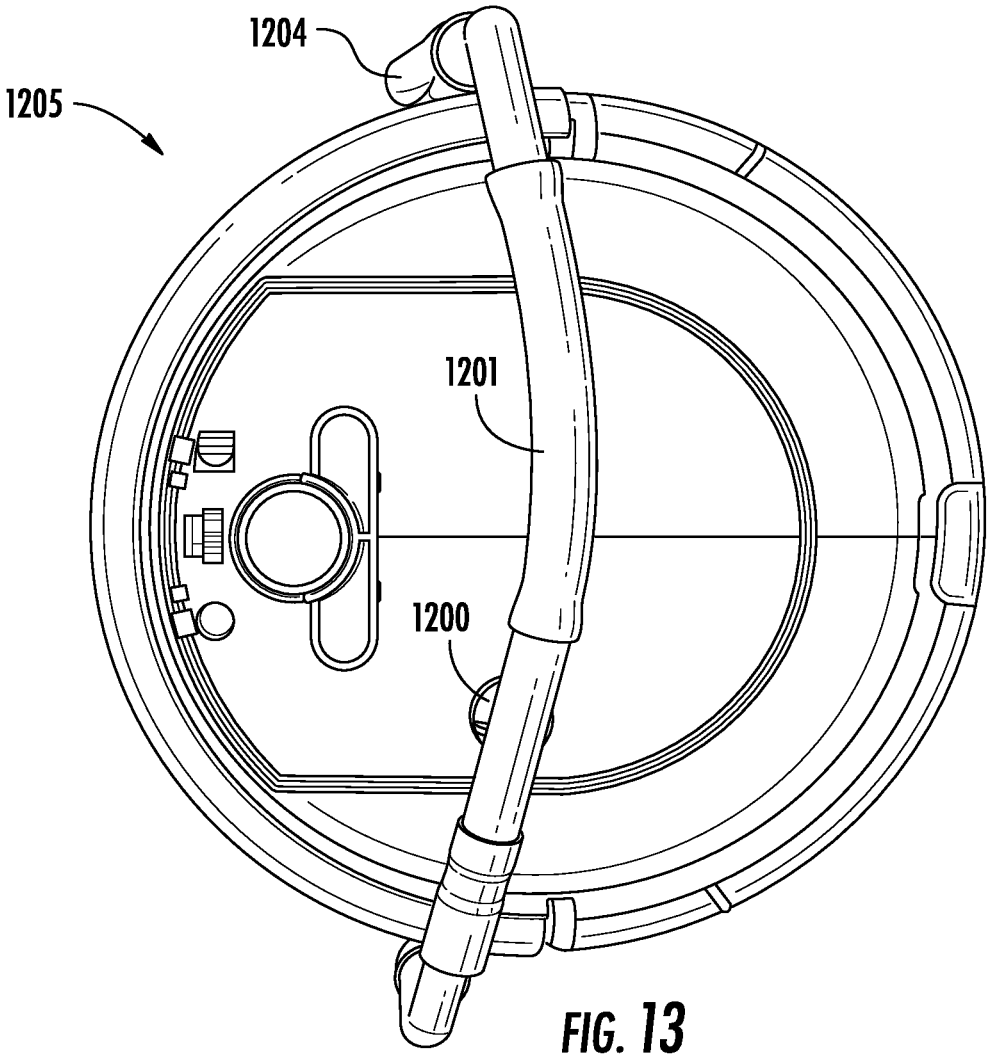
FIG. 13 is a top view of the robotic cleaner of FIG. 12, consistent with embodiments of the present disclosure.

FIGS. 12 and 13 show an example of a robotic cleaner 1205 having a clean air exhaust duct 1200. The clean air exhaust duct 1200 is fluidly coupled to an exhaust side of a suction motor of the robotic cleaner 1205. As such, exhaust air from the suction motor passes through the exhaust duct 1200. The exhaust duct 1200 can be fluidly coupled to one or more air jet assemblies 1204 having a nozzle configured to generate an air jet. The nozzle can be configured to generate an air jet that optimizes cleaning performance of the robotic cleaner 1205. For example, the nozzle can be configured to optimize the cleaning performance of a cleaning robot capable of carrying out one or more of vacuuming, mopping, cleaning of edges, cleaning of walls, cleaning of corners, and cleaning of different surface types (e.g., carpets or hard floors).

As shown, the exhaust duct 1200 may include an external portion (e.g., an external conduit) 1201 that extends along an external surface of the robotic cleaner 1205. In other words, at least a portion of the exhaust duct 1200 may extend along an external surface of the robotic cleaner 1205. The external portion 1201 may be fluidly coupled to the air jet assembly 1204.

In some instances, the one or more air jet assemblies may be positioned within a bumper (e.g., a displaceable and/or deformable bumper). For example, the bumper can be deformed, relative to its initial shape, in response to the bumper engaging (e.g., contacting) an obstacle. The bumper can be configured to actuate one or more switches (e.g., mechanical, optical, and/or any other switch) when the bumper is displaced in response to engaging an obstacle. The bumper may contract such that the one or more air jet assemblies extend beyond the bumper. As such, at least one of the one or more air jet assemblies may be the cleaning element that is extended the furthest from the body of the robotic cleaner.

Figure 14:
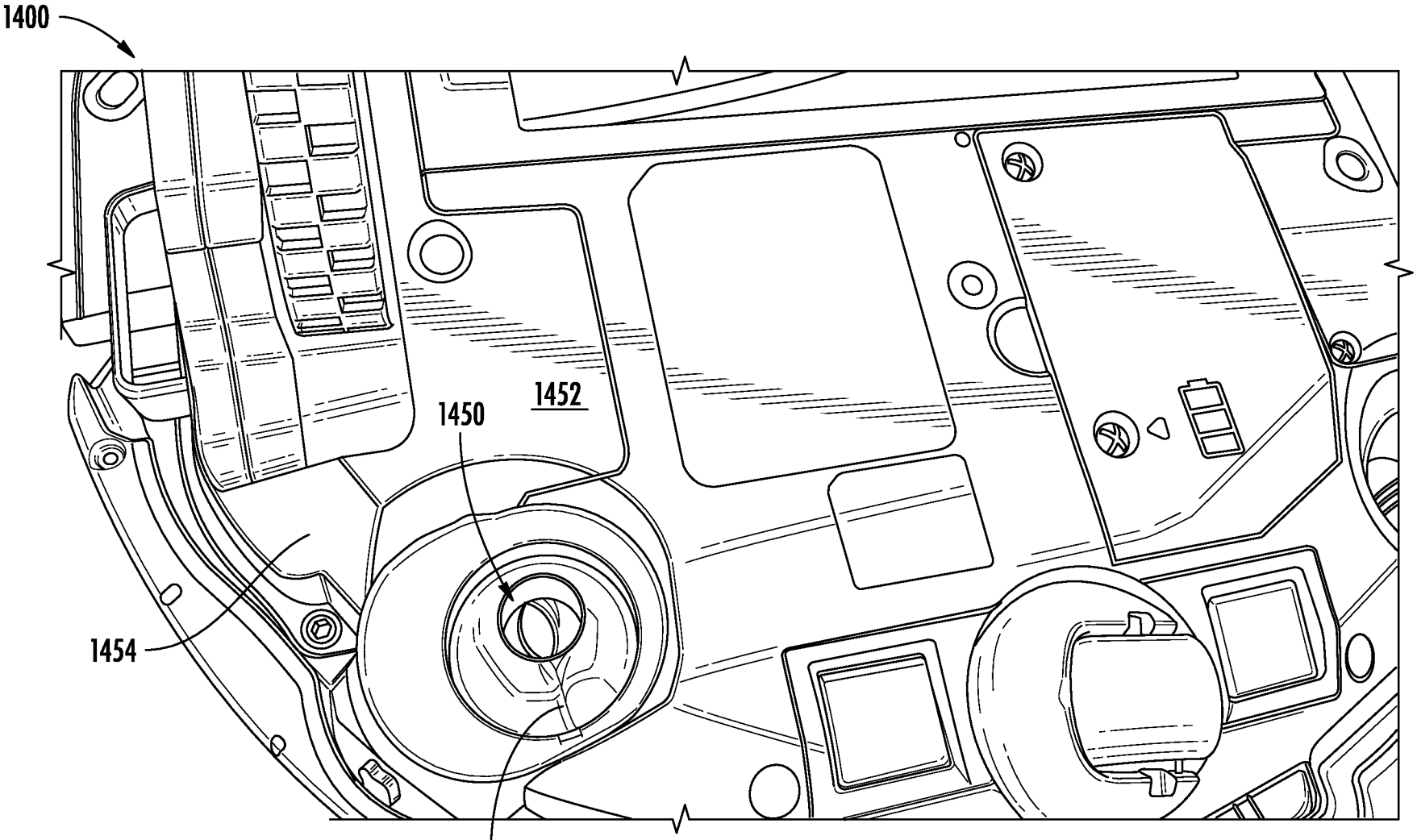
FIG. 14 is a bottom perspective view of a portion of a robotic cleaner that includes a fan assembly, consistent with embodiments of the present disclosure.

FIG. 14 illustrates an example of a robotic cleaner 1400 that includes a fan assembly 1302 configured to generate a positive air pressure at one or more air jet assemblies. The robotic cleaner 1400 includes one or more fan outlets 1450 on an underside 1452 of a housing 1454 of the robotic cleaner 1400. An air path extends from a secondary air inlet (not shown) and to the one or more fan outlets 1450. In some instances, the one or more air jet assemblies may include a respective one of the one or more fan outlets 1450. The air path may be defined by any suitable combination of rigid conduits, flexible conduits, chambers, and/or other features that may cooperate to direct a flow of air through the robotic cleaner 1400.

Figure 15A:
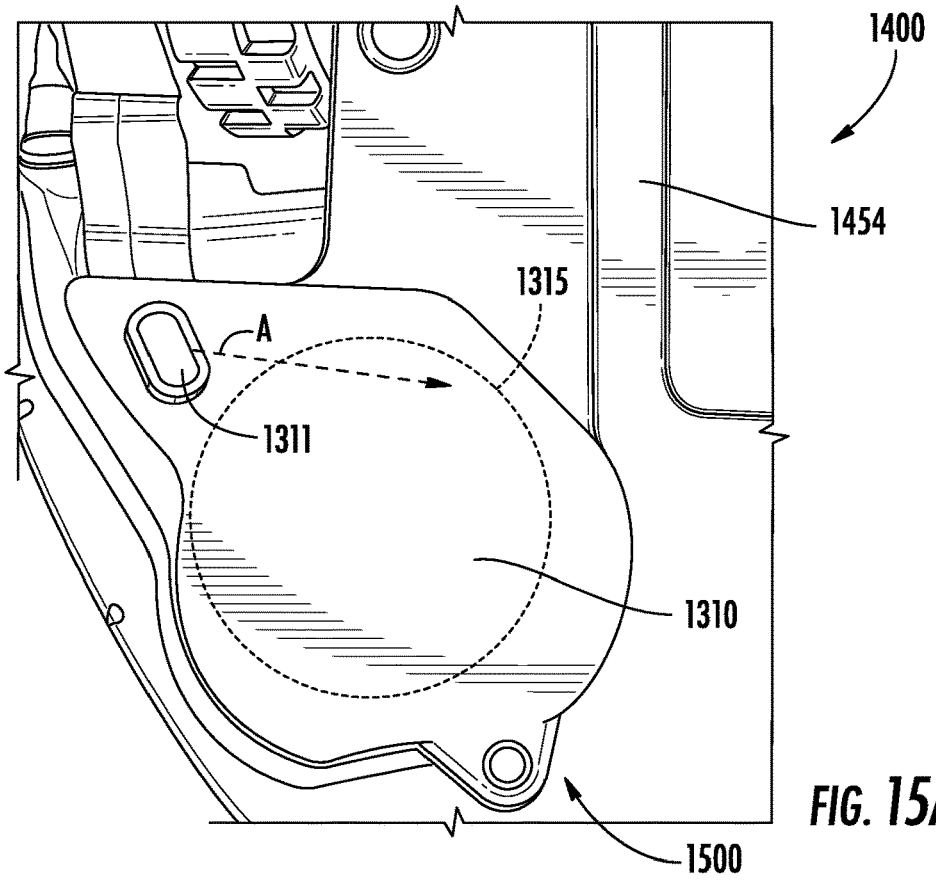
FIG. 15A is a magnified view of a portion of an example of the robotic cleaner of FIG. 14 having a nozzle attachment, consistent with embodiments of the present disclosure.
Figure 15B:
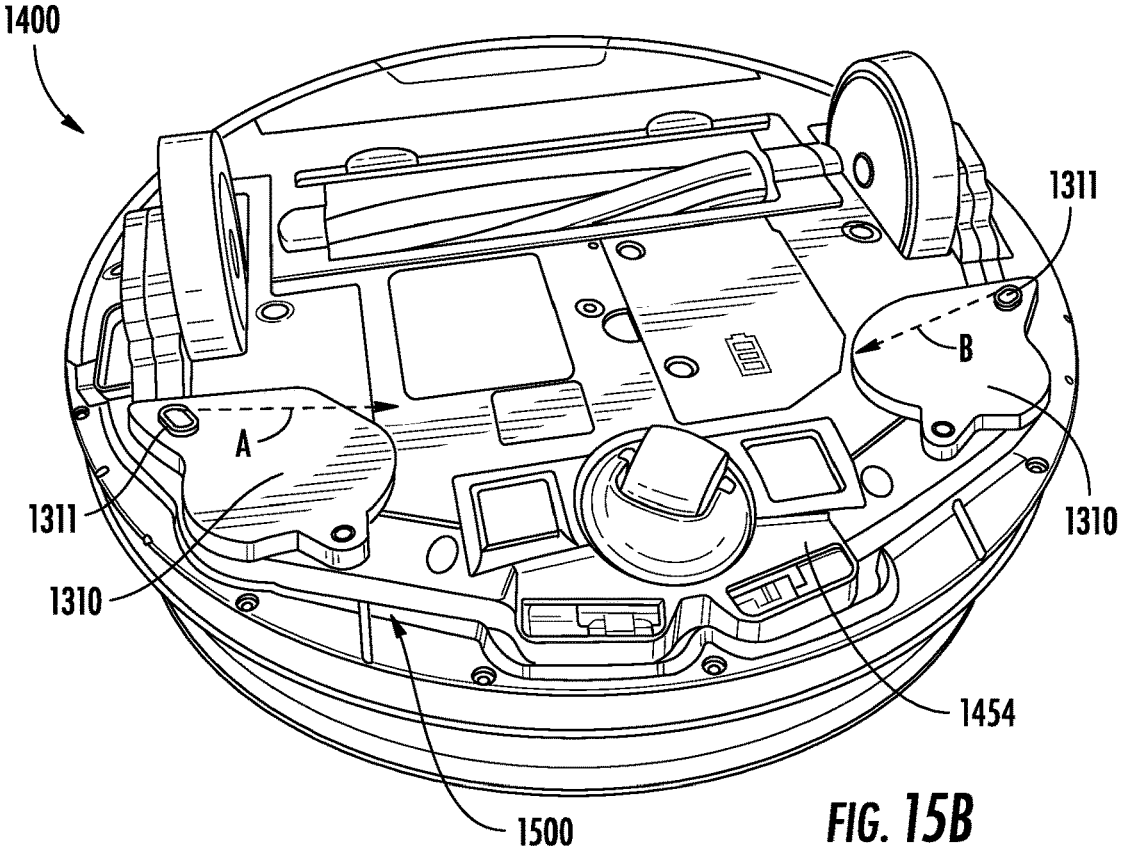
FIG. 15B shows a perspective view of the robotic cleaner of FIG. 15A, wherein the robotic cleaner includes a plurality of nozzle attachments, consistent with embodiments of the present disclosure.

FIGS. 15A-15B illustrate an embodiment of the robotic cleaner 1400 of FIG. 14 with an air jet assembly 1500 including a nozzle attachment 1310. A fan 1315 (shown in hidden lines), is fixed within the housing 1454 of the robotic cleaner 1400. Air output from the fan 1315 passes into the nozzle attachment 1310 and through a nozzle exit 1311. Air jets (illustrated as Arrows A and B) are generated by the air flow from each nozzle exit 1311. The velocity, shape, and/or direction of air defining a respective air jet is based, at least in part, on the size, shape, and/or angle of the nozzle exit 1311. Different nozzle attachments, for example, as shown in FIGS. 9A-11B, produce air jets with different properties.

Figure 16:
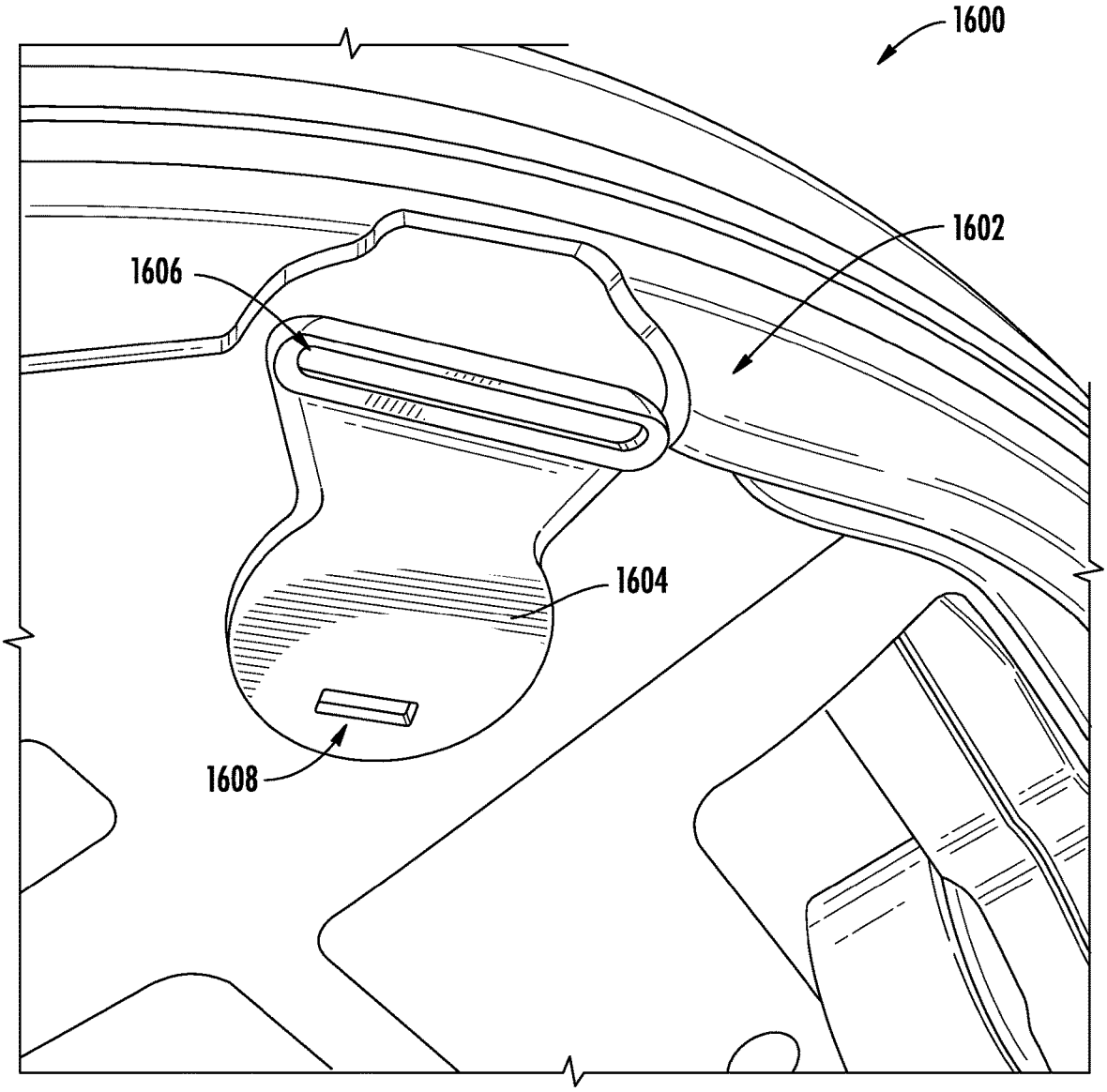
FIG. 16 is a magnified view of a portion of a robotic cleaner having an air jet assembly that includes a nozzle attachment, consistent with embodiments of the present disclosure.

FIG. 16 illustrates an embodiment of a robotic cleaner 1600 having an air jet assembly 1602 including a nozzle 1604. Air from a clean air exhaust duct or fan outlet moves through the nozzle 1604 and passes through a nozzle exit 1606, generating a first air jet. In some instances, the nozzle 1604 includes a secondary nozzle exit 1608 configured to generate a second air jet. The first air jet and second air jet may be oriented such that they cooperate to agitate debris near walls or corners. The first and second air jet may further cooperate to urge the agitated debris towards a location over which an agitator chamber of the robotic cleaner 1600 passes, allowing the collection of the debris by the robotic cleaner 1600.

Figure 17A:
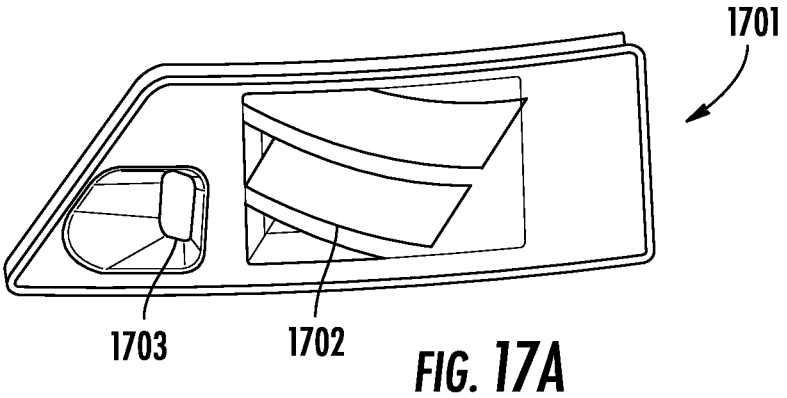
FIG. 17A is a perspective view of a vent that may be used as a component of an air jet assembly, consistent with embodiments of the present disclosure.
Figure 17B:
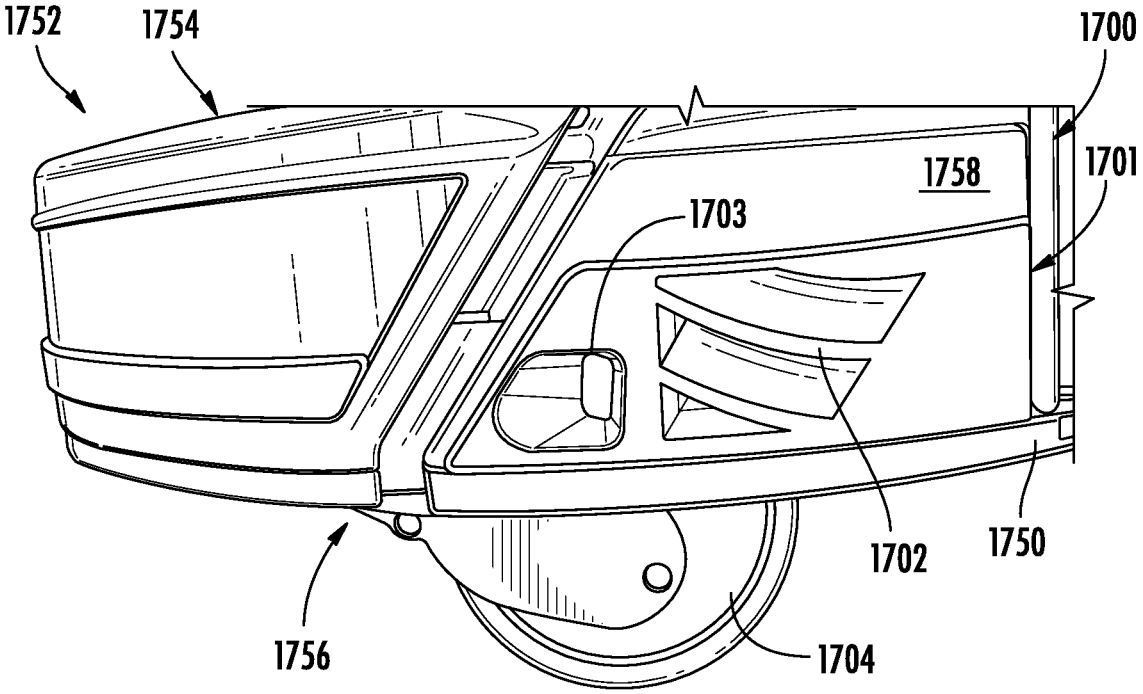
FIG. 17B is a perspective view of a portion of a robotic cleaner having the vent of FIG. 17A, consistent with embodiments of the present disclosure.

FIGS. 17A and 17B illustrate an example embodiment of an air jet assembly 1700 that includes a vent 1701. The vent 1701 includes one or more louvers 1702 configured to shape air passing therethrough into an air jet. The vent 1701 can be coupled to a body 1750 of a robotic cleaner 1752 at a location between an upper surface 1754 and an underside 1756 of the robotic cleaner 1752. In other words, the vent 1701 can define at least a portion of a sidewall 1758 of the robotic cleaner 1752, wherein the sidewall 1758 extends substantially (e.g., within 1°, 2°, 3°, 4°, or 5° of) perpendicular to the upper surface 1754 and the underside 1756 of the robotic cleaner 1752. In some instances, the vent 1701 may extend perpendicular to a surface to be cleaned.

The air jet assembly 1700 can be fluidly coupled to an exhaust side of a suction motor of the robotic cleaner 1752. As such, air exhausted from the suction motor is urged through the vent 1701. The one or more louvers 1702 can direct and/or shape air passing through the vent 1701, forming an air jet. For example, the one or more louvers 1702 can be configured to generate an air jet that urges debris into a movement path of the robotic cleaner 1752. In some instances, one or more louvers 1702 may be configured such that the air jet extends forward of one or more robotic cleaner wheels 1704. Such a configuration may reduce and/or prevent ingress of debris into the robotic cleaner 1752 as a result of rotational movement of the robotic cleaner wheels 1704. As such, in some instances, the vent 1701 can generally be described as being positioned and/or configured to mitigate or prevent debris ingress into the robotic cleaner 1752 as a result of rotation of the one or more robotic cleaner wheels 1704.

In some instances, the one or more louvers 1702 may be articulable. For example, the one or more louvers 1702 may be coupled to an articulation motor configured to articulate the one or more louvers 1702 in response to signals received from a controller of the robotic cleaner 1752. Additionally, or alternatively, the vent 1701 may further include a secondary air outlet 1703 configured to generate a secondary air jet. The secondary air outlet 1703 may include one or more of one or more secondary louvers, a nozzle, and/or any other component configured to generate an air jet.

Figure 18:
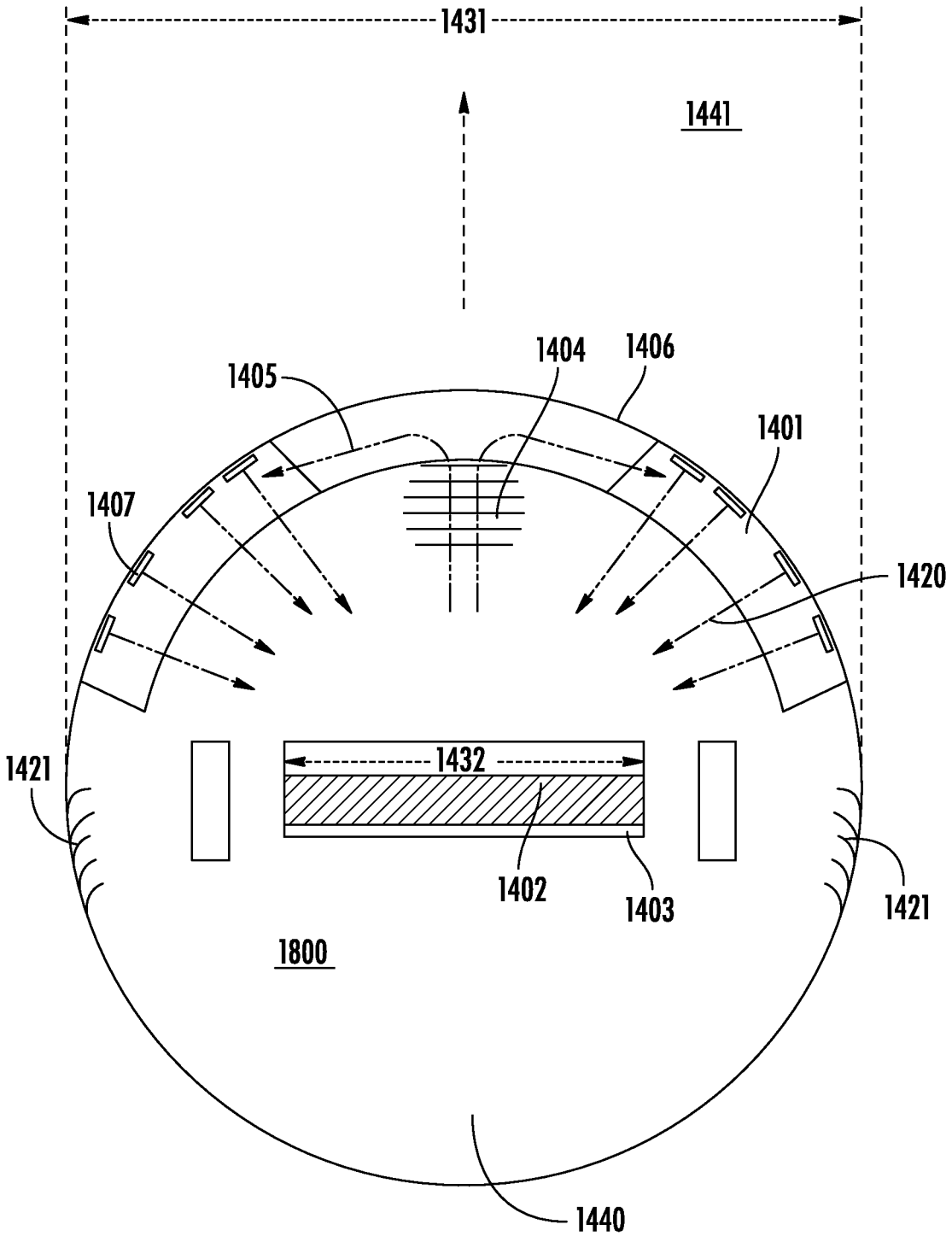
FIG. 18 is a schematic view of a robotic cleaner that includes a ducting system, consistent with embodiments of the present disclosure.

FIG. 18 is a schematic view of an example ducting system capable of being used with a robotic cleaner 1440. FIG. 18 illustrates radial perimeter air jet zones 1401 from which air jets 1420 extend. The air jets 1420 agitate debris at a perimeter of the robotic cleaner 1440. As such, the air jets 1420 may be generally described as being a perimeter agitator. The air jets 1420 urge debris towards a path of an agitator 1402 and an agitator chamber 1403. As the robotic cleaner 1440 moves along the surface to be cleaned 1441, air enters the agitator chamber 1403, moves through a suction motor and passes through a filter (not shown). Exhaust air 1405 passes from the suction motor and is directed towards an exhaust vent 1404. The exhaust air 1405 travels through an internal air path formed via a bumper duct 1406. The bumper duct 1406 fluidly connects to the radial perimeter air jet zones 1401. The exhaust air 1405 passes into the radial perimeter air jet zones 1401 and exits in the form of air jets 1420 via one or more air jet assemblies 1407. These one or more air jet assemblies 1407 may include one or more of one or more vents and/or one or more nozzles.

In the absence of agitation along the edge of the robotic cleaner 1440, the effective cleaning width of the robotic cleaner 1440 is the width 1432 of the opening to the agitator chamber 1403 disposed along an underside 1800 of the robotic cleaner 1440. In operation, the radial perimeter air jet zones 1401 increase an effective cleaning width 1431 of the robotic cleaner by urging debris into the path of the agitator 1402 and the agitator chamber 1403.

In some instances, the robotic cleaner 1440 may include at least one air jet assembly (including, for example, one or more of a nozzle or a vent) that extends (or is disposed) within a sidewall of the robotic cleaner 1440 that extends substantially perpendicular to the underside 1800 of the robotic cleaner 1440. For example, at least one air jet assembly may be configured to direct an air jet assembly in a direction of a wall or other obstacle positioned alongside the robotic cleaner. In this example, the air jet may be configured to generate an air jet that extends in a direction of forward movement of the robotic cleaner and generally towards the wall or other obstacle. As such, the air jet may urge debris deposited along the wall or other obstacle in a direction towards a forward movement path of the robotic cleaner 1440.

In some instances, the robotic cleaner 1440 may include a plurality air jet assemblies 1407, wherein at least one air jet assembly 1407 has a configuration that is different from that of at least one other air jet assembly 1407. For example, at least one air jet assembly 1407 may include a vent 1421 disposed on or in a sidewall of the robotic cleaner 1440 and at least one air jet assembly having a nozzle that is disposed on the underside 1800 of the robotic cleaner 1440, wherein the air jet assemblies 1407 cooperate to urge debris towards the agitator chamber 1403.

In some instances, one or more air jet assemblies 1407 may be controlled based on environmental conditions (e.g., obstacles, floor type, and/or any other condition). For example, when one or more sensors of the robotic cleaner 1440 detect an obstacle, such as a wall, air flow may be directed to the air jet assembly 1407 closest the obstacle.

Figure 19:
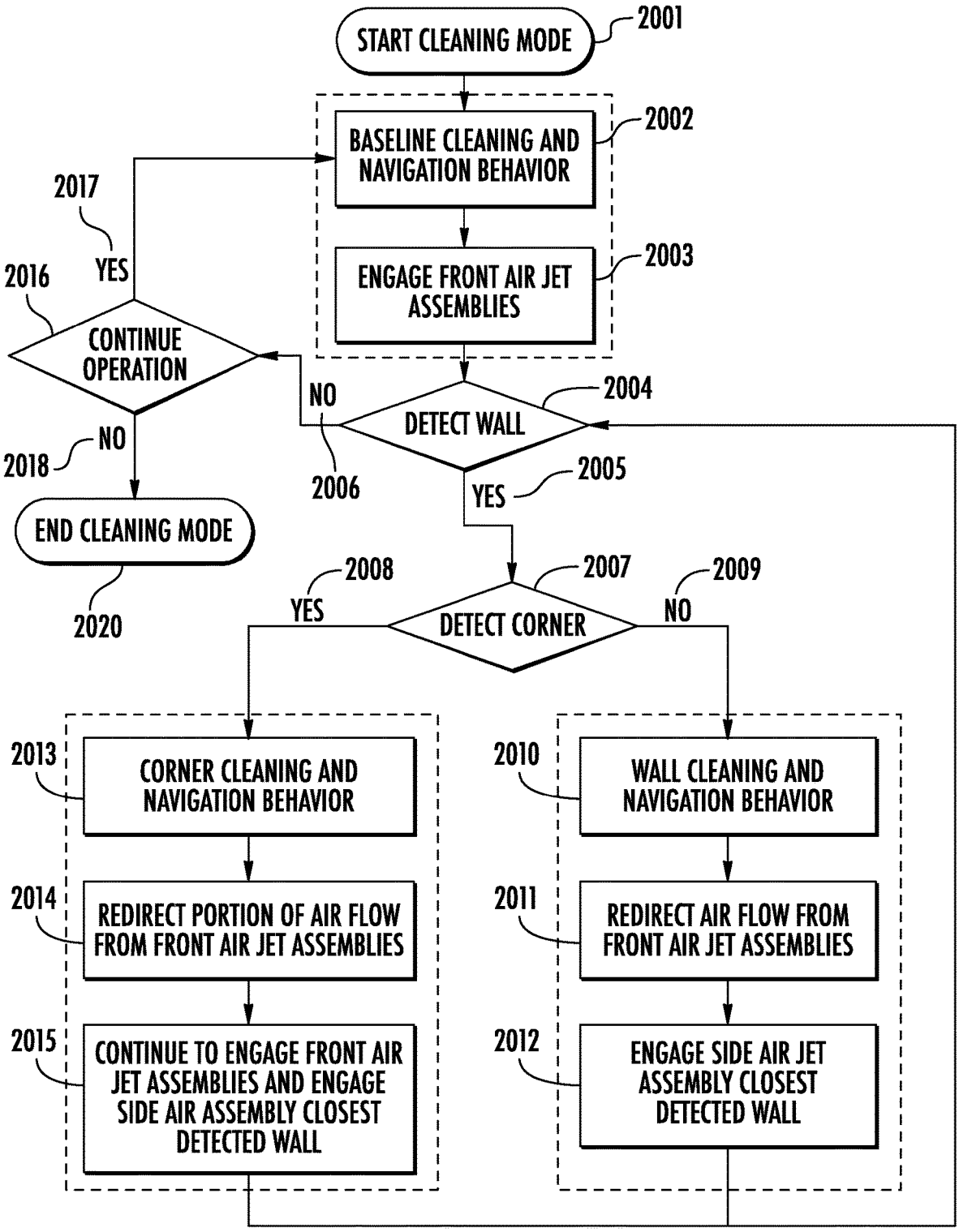
FIG. 19 is a flow chart of one example of an algorithm for determining when to generate an air jet using a corresponding air jet assembly, consistent with embodiments of the present disclosure.

FIG. 19 is a flow chart of one example of an algorithm for determining when to cause one or more air jets to be generated from a respective air jet assembly (which may generally be referred to as engaging an air jet assembly), consistent with embodiments of the present disclosure.

In an example algorithm, the robotic cleaner begins cleaning 2001 a surface according to a cleaning mode. As the robotic cleaner moves across the surface it operates using baseline cleaning and navigation behavior 2002. The baseline cleaning and navigation behavior may include using front air jet assemblies during the cleaning process. The front air jet assemblies may be engaged 2003 during normal cleaning operation in order to generate an air jet configured to urge debris to a location under the robotic cleaner such that the debris moves into the path of an agitator chamber. As the robotic cleaner moves across the surface to be cleaned, the robotic cleaner may encounter a variety of different obstacles. The robotic cleaner may have a variety of different sensors including those that detect walls 2004. When a wall is not detected 2006, the robotic cleaner determines whether to continue operation 2016. If the robotic cleaner determines to continue operation 2017, the robotic cleaner resumes operating using baseline cleaning and navigation behavior 2002. If the robotic cleaner determines not to continue operation 2018, the robotic cleaner ends cleaning mode 2020.

When a wall is detected 2005 by the robotic cleaner, a controller may then use the available sensor data to determine if the robotic cleaner has encountered a corner 2007. When a corner has not been detected 2009, the robotic cleaner initiates wall cleaning and navigation behavior 2010. The controller redirects air flow generated by suction motor exhaust or fans from front air jet assemblies 2011. The redirected air flow is directed towards a side air jet assembly. In embodiments with multiple side air jet assemblies, the redirected air flow is directed towards the side air jet assembly closest to the detected wall 2012.

When a corner has been detected 2008, the robotic cleaner initiates corner cleaning and navigation behavior 2013. The controller redirects a portion of air flow generated by suction motor exhaust and/or one or more fans from front air jet assemblies 2014. The redirected portion of air flow is directed towards a side air jet assembly. In embodiments with multiple side air jet assemblies, the portion of redirected air flow is directed towards the side air jet assembly closest to the detected wall 2015. As such, the front air jet assemblies and side air jet assemblies may generally be described as being configured to work together to urge debris out of corners, creating a wider cleaning path.

Figure 20:
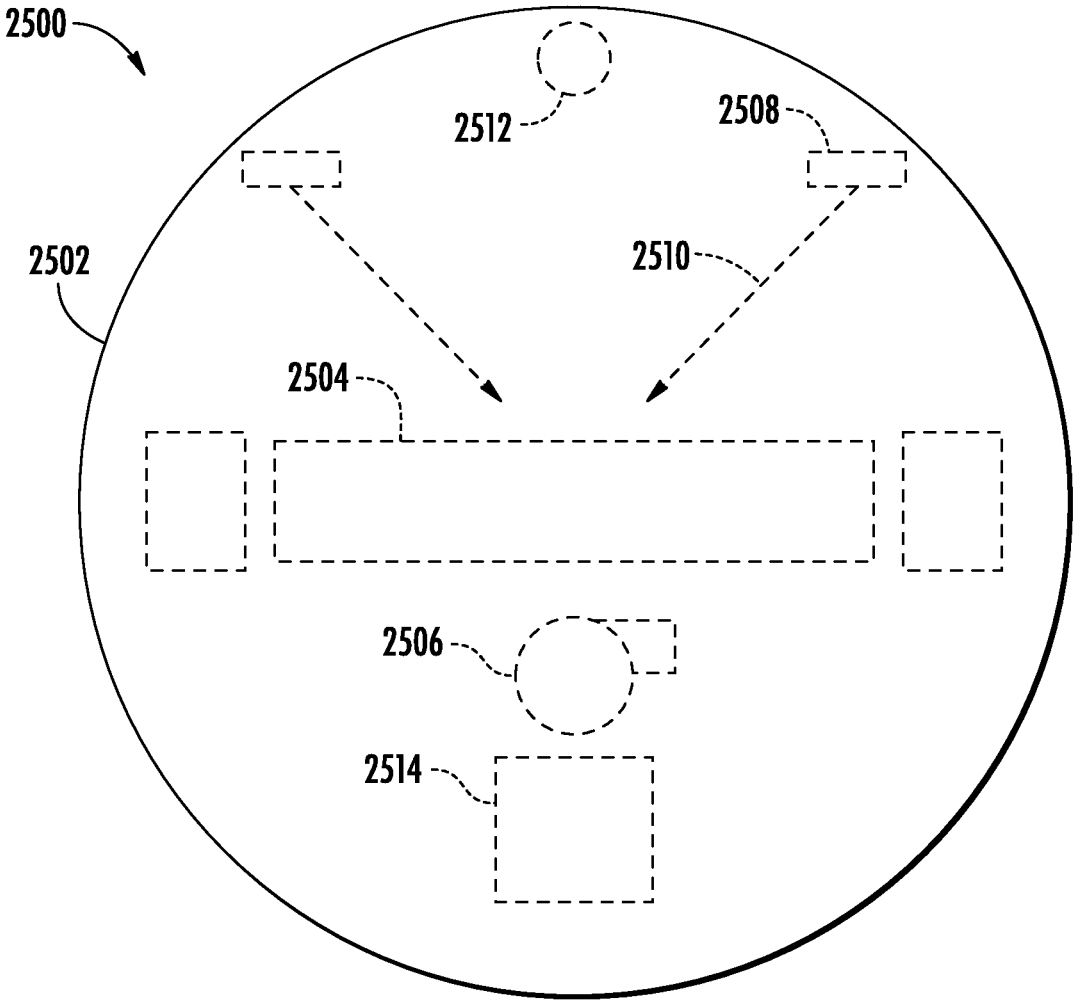
FIG. 20 is a schematic example of a robotic cleaner, consistent with embodiments of the present disclosure.

FIG. 20 shows a schematic example of a robotic cleaner 2500 having a body 2502, an agitator chamber 2504 defined in the body 2502, a suction motor 2506 fluidly coupled to the agitator chamber 2504 and configured to cause air to flow into the agitator chamber 2504, and at least one air jet assembly 2508. The at least one air jet assembly 2508 can be configured to generate an air jet 2510. The air jet 2510 is configured to urge debris towards the agitator chamber 2504. In some instances, there may be two or more air jet assemblies 2508, each being configured to generate a respective air jet 2510. In this instance, the two or more air jet assemblies 2508 may be configured to urge debris towards the agitator chamber 2504. In instances having two or more air jet assemblies 2508, at least one air jet assembly 2508 may have a configuration that is different from that of at least one other air jet assembly 2508.

While the air jet 2510 is shown as extending inboard, other configurations are possible. For example, the air jet 2510 may extend outboard from the robotic cleaner 2500 such that the air jet 2510 extends beyond a perimeter of the robotic cleaner 2500. In this example, the air jet 2510 may be incident on a vertical surface (e.g., a wall or other obstacle) and the vertical surface may urge the air jet 2510 back in a direction of the robotic cleaner 2500 (e.g., towards the agitator chamber 2504). At least a portion of any debris adjacent the vertical surface may become entrained within air defining the air jet 2510 and be urged toward the agitator chamber 2504.

The air jet assembly 2508 may include any combination of components described herein including, for example, a vent and/or a nozzle, wherein the vent and/or nozzle is configured to generate a respective air jet 2510. The air jet assembly 2508 may be coupled to an underside of the body 2502 and/or to a sidewall of the body 2502. For example, when the robotic cleaner 2500 includes two or more air jet assemblies 2508, at least one air jet assembly 2508 may be coupled to the sidewall of the body 2502 and at least one other air jet assembly 2508 may be coupled to the underside of the body 2502.

In some instances, and as shown, the robotic cleaner 2500 may further include an obstacle detection sensor 2512. The obstacle detection sensor 2512 may be coupled to the body 2502 and be configured to detect an obstacle. The obstacle detection sensor 2512 can output a signal to a controller 2514. The controller 2514 may be configured to determine a location of a detected obstacle relative to the robotic cleaner 2500 based, at least in part, on the signal output from the obstacle detection sensor 2512. Based, at least in part, on the determined location of the detected obstacle, the controller 2514 can cause an air jet 2510 to be generated from an air jet assembly 2508 that is closest to the obstacle.

An example of a robotic cleaner, consistent with the present disclosure, may include a body, an agitator chamber defined in the body, a suction motor fluidly coupled to the agitator chamber and configured to cause air to flow into the agitator chamber, and at least one air jet assembly coupled to the body, the air jet assembly being configured to generate an air jet, the air jet being configured to urge debris toward the agitator chamber.

In some instances, the at least one air jet assembly may be fluidly coupled to an exhaust side of the suction motor. In some instances, the at least one air jet assembly may include a vent configured to generate the air jet. In some instances, the at least one air jet assembly may include a nozzle configured to generate the air jet. In some instances, the at least one air jet assembly may be coupled to a sidewall of the body that extends between an underside of the body and an upper surface of the body. In some instances, the at least one air jet assembly may include a vent. In some instances, the at least one air jet assembly may be disposed on an underside of the body. In some instances, the robotic cleaner may further include a plurality of air jet assemblies, wherein at least one air jet assembly has a different configuration than that of at least one other air jet assembly. In some instances, at least one air jet assembly may include a vent and at least one other air jet assembly may include a nozzle. In some instances, at least one air jet assembly may be coupled to a sidewall of the body that extends between an underside of the body and an upper surface of the body and at least one other air jet assembly may be coupled to the underside of the body. In some instances, the at least one air jet assembly may be fluidly coupled to a fan.

Another example of a robotic cleaner, consistent with the present disclosure, may include a body, an obstacle detection sensor coupled to the body, the obstacle detection sensor being configured to detect an obstacle, an agitator chamber defined in the body, a suction motor fluidly coupled to the agitator chamber and configured to cause air to flow into the agitator chamber, and a plurality of air jet assemblies coupled to the body, the plurality of air jet assemblies each being configured to generate an air jet, each air jet being configured to urge debris toward the agitator chamber.

In some instances, the plurality of air jet assemblies may be configured to generate a respective air jet based, at least in part, on an output generated by the obstacle detection sensor. In some instances, at least one air jet assembly may include a vent and at least one other air jet assembly may include a nozzle. In some instances, at least one air jet assembly may be coupled to a sidewall of the body that extends between an underside of the body and an upper surface of the body and at least one other air jet assembly may be coupled to the underside of the body. In some instances, at least one air jet assembly may be fluidly coupled to an exhaust side of the suction motor. In some instances, at least one air jet assembly may be fluidly coupled to a fan. In some instances, at least one air jet assembly may include a vent configured to generate the air jet. In some instances, at least one air jet assembly may include a nozzle configured to generate the air jet. In some instances, the plurality of air jet assemblies may be positioned along a perimeter of the body.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. A robotic cleaner comprising:

a body having an upper surface, an underside, and a sidewall extending therebetween;

an agitator chamber defined in the body;

a suction motor fluidly coupled to the agitator chamber and configured to cause air to flow into the agitator chamber;

a controller communicatively coupled to one or more sensors;

at least one air jet assembly coupled to the body, wherein at least a portion of the at least one air jet assembly extends between the upper surface and the underside and defines at least a portion of the sidewall, the at least one air jet assembly being configured to generate an outwardly extending air jet, the air jet being configured to intersect a vertically extending surface alongside the robotic cleaner and urge debris toward a forward movement path of the robotic cleaner; and a fan fluidly coupled to the air jet assembly, wherein the controller selectively activates the fan based, at least in part, on an output from at least one of the one or more sensors.

2. The robotic cleaner of claim 1, wherein the at least one air jet assembly is fluidly coupled to an exhaust side of the suction motor.

3. The robotic cleaner of claim 1, wherein the at least one air jet assembly includes a vent configured to generate the air jet.

4. The robotic cleaner of claim 1, wherein the at least one air jet assembly includes a nozzle configured to generate the air jet.

5. The robotic cleaner of claim 1, wherein the at least one air jet assembly includes a vent.

6. The robotic cleaner of claim 1, further comprising a plurality of air jet assemblies, wherein at least one air jet assembly is disposed on the underside of the body.

7. The robotic cleaner of claim 1, further comprising a plurality of air jet assemblies, wherein at least one air jet assembly has a different configuration than that of at least one other air jet assembly.

8. The robotic cleaner of claim 7, wherein at least one air jet assembly includes a vent and at least one other air jet assembly includes a nozzle.

9. The robotic cleaner of claim 8, wherein at least one air jet assembly is coupled to the underside of the body.

10. A robotic cleaner comprising:

a body;

an obstacle detection sensor coupled to the body, the obstacle detection sensor being configured to detect an obstacle;

an agitator chamber defined in the body;

a suction motor fluidly coupled to the agitator chamber and configured to cause air to flow into the agitator chamber;

a plurality of air jet assemblies coupled to the body, the plurality of air jet assemblies each being configured to generate an air jet, each air jet being configured to urge debris toward the agitator chamber, wherein the plurality of air jet assemblies are configured to generate a respective air jet based, at least in part, on an output generated by the obstacle detection sensor; and at least one fan fluidly coupled to the plurality of air jet assemblies.

11. The robotic cleaner of claim 10, wherein at least one air jet assembly includes a vent and at least one other air jet assembly includes a nozzle.

12. The robotic cleaner of claim 11, wherein at least one air jet assembly is coupled to a sidewall of the body that extends between an underside of the body and an upper surface of the body and at least one other air jet assembly is coupled to the underside of the body.

13. The robotic cleaner of claim 10, wherein at least one air jet assembly is fluidly coupled to an exhaust side of the suction motor.

14. The robotic cleaner of claim 10, wherein at least one air jet assembly includes a vent configured to generate the air jet.

15. The robotic cleaner of claim 10, wherein at least one air jet assembly includes a nozzle configured to generate the air jet.

16. The robotic cleaner of claim 10, wherein the plurality of air jet assemblies are positioned along a perimeter of the body.

17. A robotic cleaner comprising:

a body;

an obstacle detection sensor coupled to the body, the obstacle detection sensor being configured to detect an obstacle;

an agitator chamber defined in the body;

a suction motor fluidly coupled to the agitator chamber and configured to cause air to flow into the agitator chamber; and an air jet assembly coupled to the body, the air jet assembly being configured to generate an air jet, the air jet being configured to urge debris toward a movement path of the robotic cleaner, wherein the air jet assembly is configured to generate the air jet based, at least in part, on an output generated by the obstacle detection sensor; and a fan fluidly coupled to the air jet assembly.

18. The robotic cleaner of claim 17, wherein the air jet extends outwardly from body such that the air jet is configured to intersect a surface alongside the robotic cleaner.

* * * * *